US008112286B2

(12) United States Patent
Goto et al.

(10) Patent No.: US 8,112,286 B2
(45) Date of Patent: Feb. 7, 2012

(54) STEREO ENCODING DEVICE, AND STEREO SIGNAL PREDICTING METHOD

(75) Inventors: Michiyo Goto, Tokyo (JP); Koji Yoshida, Kanagawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 954 days.

(21) Appl. No.: 12/091,793

(22) PCT Filed: Oct. 30, 2006

(86) PCT No.: PCT/JP2006/321673

§ 371 (c)(1),
(2), (4) Date: Apr. 28, 2008

(87) PCT Pub. No.: WO2007/052612

PCT Pub. Date: May 10, 2007

(65) Prior Publication Data

US 2009/0119111 A1 May 7, 2009

(30) Foreign Application Priority Data

Oct. 31, 2005 (JP) ..... 2005-316754
Jun. 15, 2006 (JP) ..... 2006-166458
Oct. 2, 2006 (JP) ..... 2006-271040

(51) Int. Cl.
*G10L 19/00* (2006.01)
*H04H 20/47* (2008.01)

(52) U.S. Cl. ..... 704/501; 704/219; 381/2

(58) Field of Classification Search ..... None
See application file for complete search history.

(56) References Cited

U.S. PATENT DOCUMENTS 5,491,773 A * 2/1996 Veldhuis et al. ..... 704/229
5,511,093 A * 4/1996 Edler et al. ..... 375/240
5,621,855 A * 4/1997 Veldhuis et al. ..... 704/229
6,360,200 B1 * 3/2002 Edler et al. ..... 704/219
7,191,136 B2 * 3/2007 Sinha et al. ..... 704/500
7,573,912 B2 * 8/2009 Lindblom ..... 370/487
7,742,912 B2 * 6/2010 Den Brinker ..... 704/200.1

(Continued)

FOREIGN PATENT DOCUMENTS

GB 2279214 A 12/1994
JP 7-87033 3/1995

OTHER PUBLICATIONS

Fuchs, "Improving MPEG Audio Coding by Backward Adaptive Linear Stereo Prediction", Presented at the 99th AES Convention, Oct. 6-9, 1995.*

(Continued)

*Primary Examiner* — Brian Albertalli
(74) *Attorney, Agent, or Firm* — Greenblum & Bernstein, P.L.C.

(57) ABSTRACT

A prediction performance between individual channels of a stereo signal is improved to improve a sound quality of a decoded signal. A first low pass filter LPF interrupts a high-range component of a first channel signal S1, and outputs a first low-range component S1'. A second low pass filter LPF interrupts a high-range component of a second channel signal S2, and outputs a second low-range component S2'. A predictor predicts the S2' from the S1', and outputs a prediction parameter composed of a delay time difference t and an amplitude ratio g. first channel encoder encodes the S1. A prediction parameter encoder encodes the prediction parameter. The encoded parameters of the encoded parameter of the S1 and the prediction parameter are then outputted.

16 Claims, 23 Drawing Sheets

U.S. PATENT DOCUMENTS

| | | | | |
|---|---|---|---|---|
| 7,797,162 | B2 * | 9/2010 | Yoshida et al. | 704/500 |
| 2003/0012277 | A1 | 1/2003 | Azuma et al. | |
| 2007/0233470 | A1 | 10/2007 | Goto et al. | |
| 2008/0010072 | A1 | 1/2008 | Yoshida et al. | |

OTHER PUBLICATIONS

Goto et al., "Channel—Kan Joho o Mochiita Onsei Tsushinyo Stereo Onsei Fugoka Hoho no Kento", 2005 Nen The Institute of Electronics, Information and Communication Engineers Sogo Taikai Koen Ronbunshu, D-14-2, Mar. 7, 2005, p. 119.

Goto et al., "Onsei Tsushinyo Scalable Stereo Onsei Fugoka Hoho no Kento", FIT2005 (Dai 4 Kai Forum on Information Technology) Koen Ronbunshu, G-017, Aug. 22, 2005, pp. 229-300.

Hendrik Fuchs, "Improving Joint Stereo Audio Coding by Adaptive Inter—Channel Prediction, " Applications of Signal Processing to Audio and Acoustics, Final Program and Paper Summaries, 1993 IEEE Workshop on Oct. 17-20, 1993, pp. 39-42.

Kazunaga Ikeda, "Audio transfer system on PHS using error-protected stereo twin VQ", IEEE Transactions on Consumer Electronics, vol. 44, Issue 3, Aug. 1, 1998, pp. 1032-1038, XP011008546.

* cited by examiner

STEREO ENCODING DEVICE, AND STEREO SIGNAL PREDICTING METHOD

TECHNICAL FIELD

The present invention relates to a stereo coding apparatus and a stereo signal prediction method.

BACKGROUND ART

Monaural communication at a constant bit rate is currently mainstream in speech communication such as calls using mobile telephones in a mobile communication system. However, if transmission is realized at much higher bit rates as with the fourth-generation mobile communication system in the future, it is expected that speech communication using stereo signals having higher fidelity will be widely available.

One of coding methods for stereo speech signals is disclosed in Non-Patent Document 1. This coding method predicts one channel signally from the other channel signal x using following equation 1 and encodes such prediction parameter $a_k$ and d that minimize prediction errors. Here, $a_k$ is a Kth-order prediction coefficient and d is a time difference between the two channel signals.

[1]

$$y(n) = \sum_{k=0}^{K} a_k \cdot x(n-d-k) \quad \text{(Equation 1)}$$

Non-Patent Document 1: Hendrik Fuchs, "Improving Joint Stereo Audio Coding by Adaptive Inter-Channel Prediction," Applications of Signal Processing to Audio and Acoustics, Final Program and Paper Summaries, 1993 IEEE Workshop on 17-20 Oct. 1993, Page(s) 39-42.

DISCLOSURE OF INVENTION

Problems to be Solved by the Invention

However, in order to reduce prediction errors, with the above-described coding method, it is necessary to keep the order of a prediction coefficient at a certain order or higher, and, consequently, there is a problem that the coding bit rate increases. For example, if the order of a prediction coefficient is set a low level to lower the coding bit rate, prediction performance deteriorates and sound quality degrades auditorily.

It is therefore an object of the present invention to provide a stereo coding apparatus and stereo signal prediction method that improve prediction performance between channels of a stereo signal and improve sound quality of decoded signals.

Means for Solving the Problem

The stereo coding apparatus of the present invention employs a configuration having: a first low pass filter that lets a low-band component of a first channel signal pass; a second low pass filter that lets a low-band component of a second channel signal pass; a prediction section that predicts the low-band component of the second channel signal from the low-band component of the first channel signal and generates a prediction parameter; a first coding section that encodes the first channel signal; and a second coding section that encodes the prediction parameter.

Furthermore, the stereo signal prediction method of the present invention includes: a step of letting a low-band component of a first channel signal pass; a step of letting a low-band component of a second channel signal pass; and a step of predicting the low-band component of the second channel signal from the low-band component of the first channel signal.

Advantageous Effect of the Invention

According to the present invention, it is possible to improve prediction performance of a stereo signal between channels and improve sound quality of decoded signals.

BEST MODE FOR CARRYING OUT THE INVENTION

Hereinafter, embodiments of the present invention will be explained below in detail with reference to the accompanying drawings.

Embodiment 1

Figure 1:
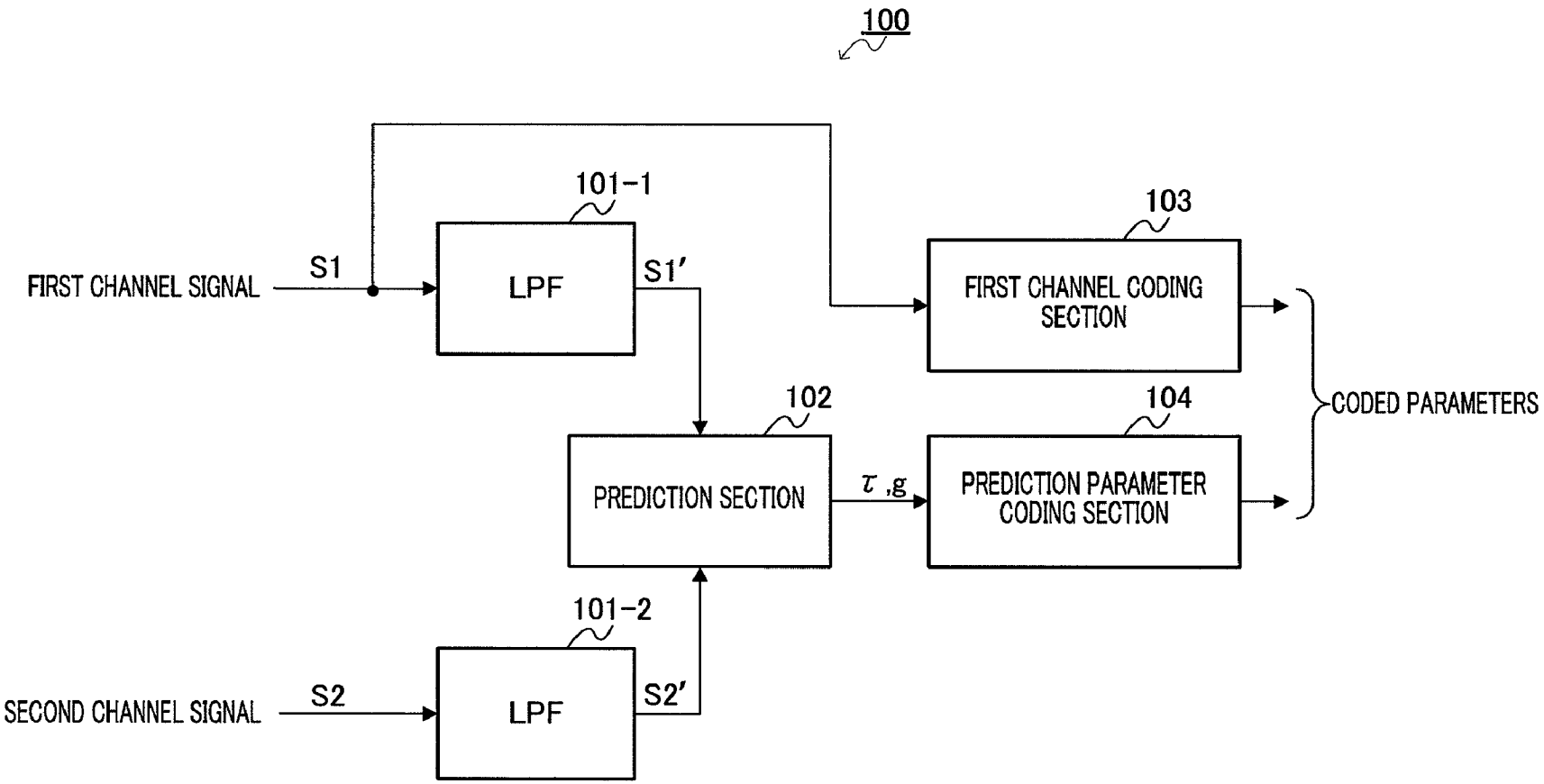
FIG. 1 is a block diagram showing the main configuration of a stereo coding apparatus according to Embodiment 1.

FIG. 1 is a block diagram showing the main configuration of stereo coding apparatus 100 according to Embodiment 1 of the present invention.

Stereo coding apparatus 100 is provided with LPF 101-1, LPF 101-2, prediction section 102, first channel coding section 103 and prediction parameter coding section 104, and receives a stereo signal comprised of a first channel signal and a second channel signal as input, performs encoding on the stereo signal and outputs coded parameters. In the present specification, a plurality of components having similar functions will be assigned the same reference numerals and further assigned different sub-numbers to distinguish from each other.

The respective sections of stereo coding apparatus 100 operate as follows.

LPF 101-1 is a low pass filter that lets only a low-band component of the input signal (original signal) pass, and more specifically, cuts off a frequency component higher than a cut-off frequency of inputted first channel signal S1, and outputs first channel signal S1' with only the low-band component remained, to prediction section 102. Likewise, LPF 101-2 also cuts off a high-band component of inputted second channel signal S2 using the same cut-off frequency as that of LPF 101-1, and outputs second channel signal S2' with only the low-band component, to prediction section 102.

Prediction section 102 predicts the second channel signal from the first channel signal using first channel signal S1' (low-band component) outputted from LPF 101-1 and second channel signal S2' (low-band component) outputted from LPF 101-2, and outputs information of this prediction (prediction parameter) to prediction parameter coding section 104. More specifically, prediction section 102 compares signal S1' with signal S2', calculates delay time difference τ between these two signals and amplitude ratio g (both are values based on the first channel signal), and outputs these values to prediction parameter coding section 104 as prediction parameters.

First channel coding section 103 carries out predetermined encoding processing on original signal S1 and outputs coded parameters obtained for the first channel. If the original signal is a speech signal, first channel coding section 103 performs encoding using, for example, a CELP (Code-Excited Linear Prediction) scheme and outputs CELP parameters such as an adaptive codebook lag and LPC coefficients as the coded parameters. On the other hand, if the original signal is an audio signal, first channel coding section 103 performs encoding using, for example, an AAC (Advanced Audio Coding) scheme defined by MPEG-4 (Moving Picture Experts Group phase-4), and outputs the obtained coded parameters.

Prediction parameter coding section 104 applies predetermined encoding processing to the prediction parameters outputted from prediction section 102 and outputs the obtained coded parameter. For example, in the predetermined encoding processing, prediction parameter coding section 104 adopts a method of providing a codebook storing prediction parameter candidates in advance, selecting an optimum prediction parameter from this codebook and outputting an index corresponding to this prediction parameter.

Next, the above-described prediction processing carried out by prediction section 102 will be explained in further detail.

Upon calculating delay time difference τ and amplitude ratio g, prediction section 102 calculates delay time difference τ first. Delay time difference τ between low-band component S1' of the first channel signal having passed through LPF 101-1 and low-band component S2' of the second channel signal having passed through LPF 101-2 is calculated as $m=m_{max}$ that maximizes a cross-correlation function value expressed by following equation 2.

[2]

$$\phi(m) = \sum_{n=0}^{FL-1} S1'(n) \cdot S2'(n-m) \qquad \text{(Equation 2)}$$

Here, n and m are sample numbers and FL is a frame length (number of samples) The cross-correlation function is obtained by shifting one signal by m and calculating a correlation value between these two signals.

Next, prediction section 102 calculates amplitude ratio g between S1' and S2' using calculated delay time difference τ obtained according to following equation 3.

[3]

$$g = \sqrt{\frac{\sum_{n=0}^{FL-1} S2'(n-\tau)^2}{\sum_{n=0}^{Fl-1} S1'(n)^2}} \qquad \text{(Equation 3)}$$

Equation 3 calculates the amplitude ratio between S2' and S1' which is shifted by delay time difference τ.

Prediction section 102 predicts low-band component S2" of the second channel signal from low-band component S1' of the first channel signal using τ and g according to following equation 4.

[4]

$$S2''(n))=g \cdot S1'(n-\tau) \qquad \text{(Equation 4)}$$

In this way, prediction section 102 improves the prediction performance of the stereo signal by predicting the low-band component of the second channel signal using the low-band component of the first channel signal. This principle will be explained in detail below.

Figure 2A:
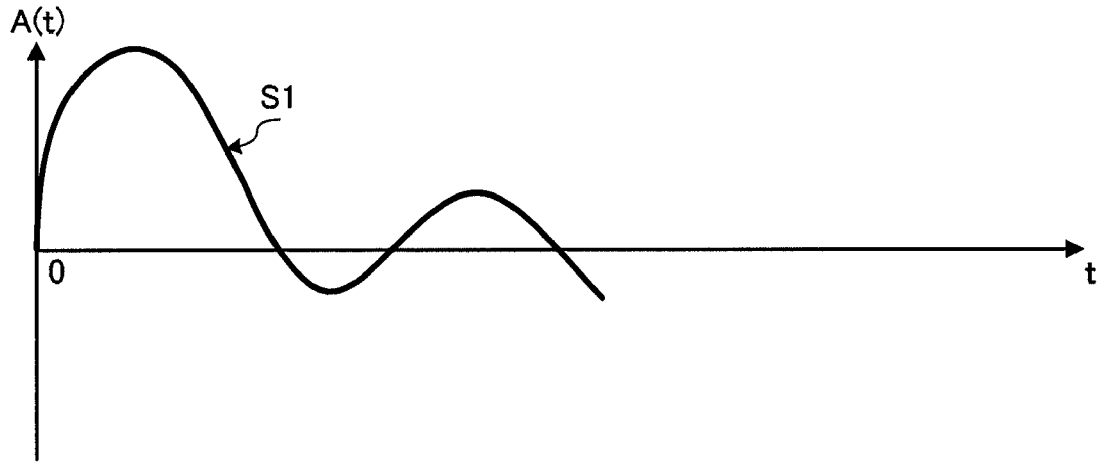
FIG. 2A shows an example of a first channel signal.
Figure 2B:
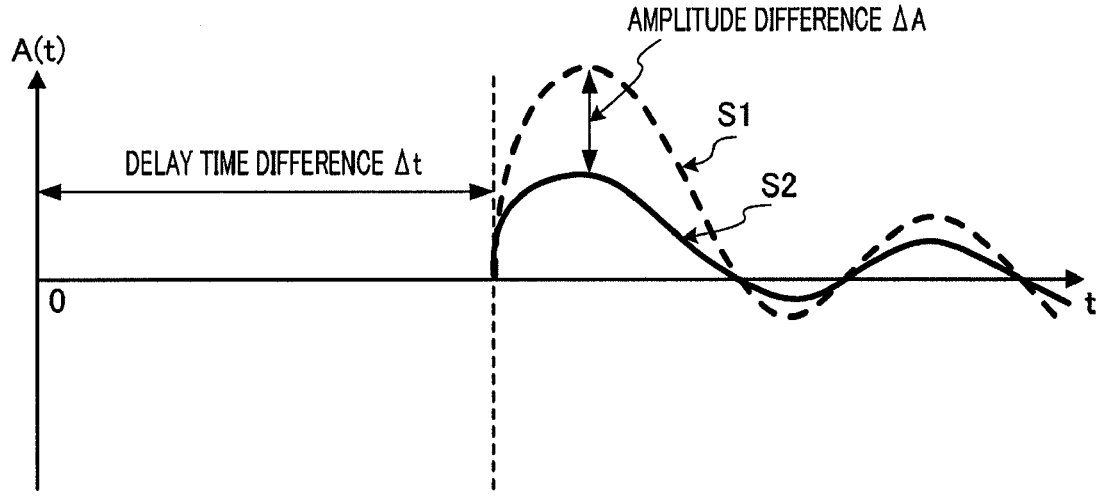
FIG. 2B shows an example of a second channel signal.

FIG. 2A and FIG. 2B show an example of the first channel signal and the second channel signal which are the original signals. Here, for ease of explanation, an example will be explained where the number of sound sources is one.

In the first place, the stereo signal is a signal obtained by collecting sound generated from a certain source, which is common to all channels, using a plurality of (two in the present embodiment) microphones apart from each other. Therefore, when the distance from the source to the microphone becomes far, attenuation of energy of the signal becomes greater, and a delay of arrival time is brought about. Therefore, as shown in FIG. 2A and FIG. 2B, although the respective channels show different waveforms, signals of both channels are made more similar by correcting delay time difference Δt and amplitude difference ΔA. Here, the parameters of delay time difference and amplitude difference are characteristic parameters determined by setting positions of the microphones, and are parameters where one set of values is associated with a signal collected by one microphone.

Figure 3:
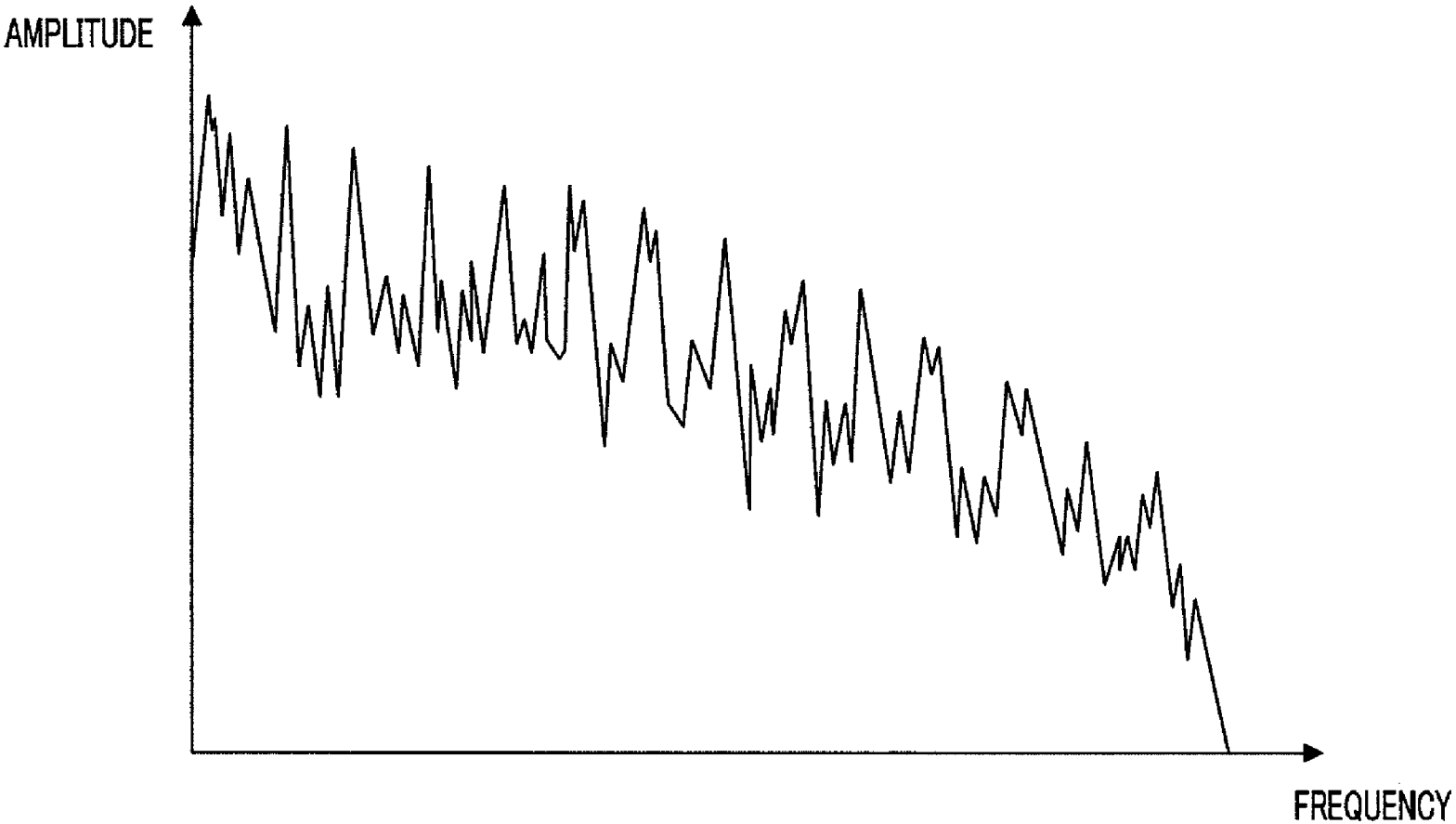
FIG. 3 illustrates features of a speech signal or audio signal.

On the other hand, as shown in FIG. 3, in a speech signal or audio signal, signal energy is weighted more in the low band than the high band. Therefore, when prediction is performed as part of encoding processing, it is desirable to perform prediction by placing more importance on the low-band component than the high-band component from the standpoint of improving prediction performance.

Therefore, the present embodiment cuts off the high-band component of an input signal and calculates a prediction parameter using the remaining low-band component. The calculated coded parameter of the prediction parameter is outputted to the decoding side. That is, although the prediction parameter is calculated based on the low-band component of the input signal, this is outputted as a prediction parameter for the entire band including the high band. As described above, one set of values of a prediction parameter is associated with a signal collected by one microphone, and so, although the prediction parameter is calculated based on only the low-band component, the prediction parameter is recognized to be effective for the entire band.

Furthermore, when prediction is performed on components including even the high-band component with low energy, the prediction performance may deteriorate due to the influence of this high-band component with low accuracy. However, the present embodiment does not use the high-band component in prediction, so that the prediction performance is unlikely to deteriorate under the influence of the high-band component.

A stereo decoding apparatus according to the present embodiment that supports stereo coding apparatus 100, receives the coded parameters of the first channel outputted from first channel coding section 103, decodes these coded parameters, and thereby obtains a decoded signal of the first channel and also obtains a decoded signal of the second channel of the entire band using the coded parameter (prediction parameter) outputted from prediction parameter coding section 104 and the decoded signal of the first channel.

In this way, according to the present embodiment, a prediction parameter is calculated by cutting off the high-band component of the first channel signal in LPF 101-1, cutting off the high-band component of the second channel signal in LPF 101-2, and predicting the low-band component of the second channel signal from the low-band component of the first channel signal in prediction section 102. By outputting the coded parameter of this prediction parameter and the coded parameters of the first channel signal, it is possible to improve prediction performance of a stereo signal between the channels and improve sound quality of decoded signals. Furthermore, the high-band component of the original signal is cut off, so that it is also possible to suppress the order of the prediction coefficient to a low level.

Although a case has been described as an example with the present embodiment where first channel coding section 103 performs encoding on the first channel signal, which is an original signal, and prediction section 102 predicts second channel signal S2' from first channel signal S1', it is also possible to employ a configuration where a second channel coding section is replaced by first channel coding section 103 and encoding is applied to the second channel signal which is the original signal. In this case, prediction section 102 predicts first channel signal S1' from second channel signal S2'.

Figure 4:
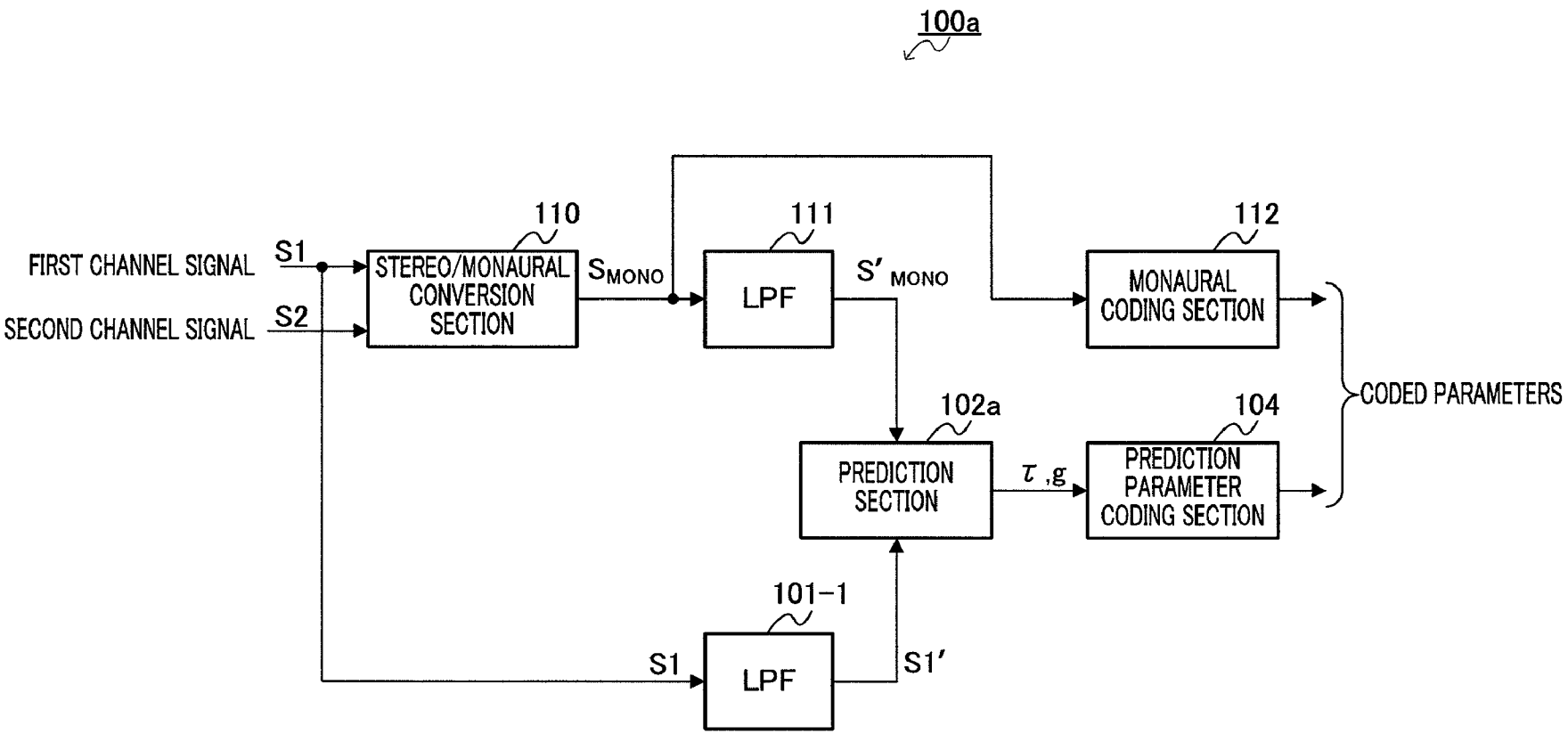
FIG. 4 is a block diagram showing the main configuration of a stereo coding apparatus according to another variation of Embodiment 1.

Furthermore, with the present embodiment, it is also possible to apply the above-described encoding to other input signals instead of using the first channel signal and second channel signal as input signals. FIG. 4 is a block diagram showing the main configuration of stereo coding apparatus 100*a* according to another variation of the present embodiment. Here, first channel signal S1 and second channel signal S2 are inputted to stereo/monaural conversion section 110, and stereo/monaural conversion section 110 converts stereo signals S1 and S2 to monaural signal $S_{MONO}$ and outputs the monaural signal.

As the conversion method in stereo/monaural conversion section 110, for example, an average signal or weighted average signal of first channel signal S1 and second channel signal S2 is obtained, and this average signal is used as monaural signal $S_{MONO}$. That is, the substantial coding targets in this variation are monaural signal $S_{MONO}$ and first channel signal S1.

Therefore, LPF 111 cuts off the high-band part of monaural signal $S_{MONO}$ and generates monaural signal $S'_{MONO}$, and prediction section 102*a* predicts first channel signal S1 from monaural signal $S'_{MONO}$ and calculates a prediction parameter. On the other hand, monaural coding section 112 is provided instead of first channel coding section 103, and this monaural coding section 112 applies predetermined encoding processing to the monaural signal $S_{MONO}$. Other operations are similar to operations of stereo coding apparatus 100.

Figure 5:
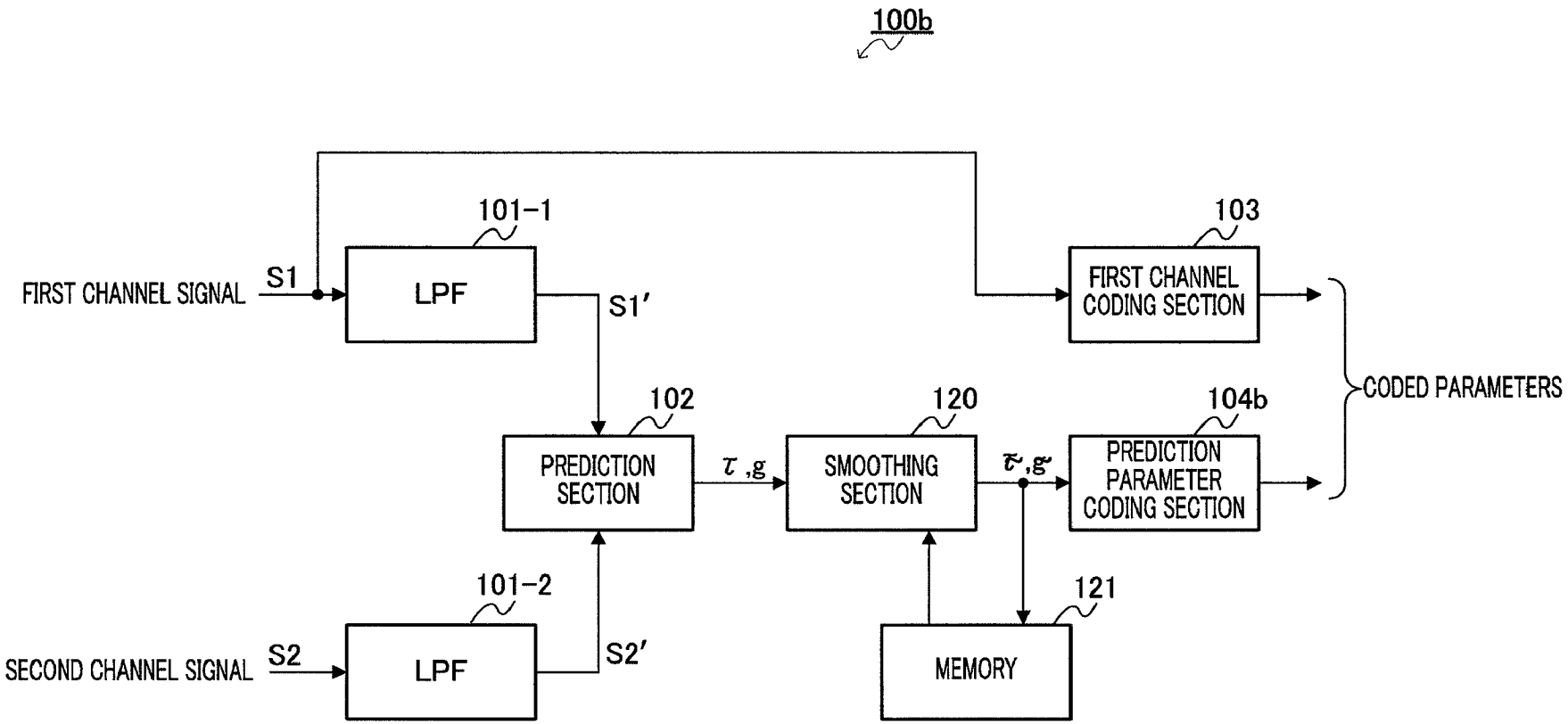
FIG. 5 is a block diagram showing the main configuration of a stereo coding apparatus according to another variation of Embodiment 1.

Furthermore, the present embodiment may also be configured so as to apply smoothing processing to the prediction parameter outputted from prediction section 102. FIG. 5 is a block diagram showing the main configuration of stereo coding apparatus 100*b* according to another variation of the present embodiment. Here, smoothing section 120 is provided after prediction section 102 which applies smoothing processing to the prediction parameter outputted from prediction section 102. Furthermore, memory 121 is provided to store the smoothed prediction parameter outputted from smoothing section 120. More specifically, smoothing section 120 applies smoothing processing shown in following equations 5 and 6 using both τ(i) and g(i) of the current frame inputted from prediction section 102 and τ(i−1) and g(i−1) of the past frame inputted from memory 121, and outputs the smoothed prediction parameter to prediction parameter coding section 104*b*.

[5]

$$\tilde{\tau}(i)=\alpha\cdot\tilde{\tau}(i-1)+(1-\alpha)\cdot\tau(i) \quad \text{(Equation 5)}$$

$$\tilde{g}(i)=\beta\cdot\tilde{g}(i-1)+(1-\beta)\cdot g(i) \quad \text{(Equation 6)}$$

Here, i is a frame number, $\tilde{\tau}$(i) and $\tilde{g}$(i) are smoothed τ(i) and g(i), and α and β are constants ranging from 0 to 1. Prediction parameter coding section 104*b* performs prediction on this smoothed prediction parameter using following equation 7 and calculates a prediction parameter.

[6]

$$S2''(n)=\tilde{g}\cdot S1'(n-\tilde{\tau}) \quad \text{(Equation 7)}$$

Other operations are similar to operations of stereo coding apparatus 100. In this way, by smoothing variations in the values of τ and g between frames, it is possible to improve the continuity between frames of prediction signal S2" of the second channel signal.

Furthermore, although a case has been described as an example with the present embodiment where delay time difference τ and amplitude ratio g are used as prediction parameters, it is also possible to employ a configuration where the second channel signal is predicted from the first channel signal through following equation 8 using delay time differ ence τ and prediction coefficient series $a_k$ instead of these parameters.

[7]

$$S2''(n) = \sum_{k=0}^{K} a_k \cdot S1'(n-\tau-k) \quad \text{(Equation 8)}$$

With this configuration, it is possible to increase prediction performance.

Furthermore, although a case has been described as an example with the present embodiment where an amplitude ratio is used as one of the prediction parameters, amplitude difference, energy ratio and energy difference may also be used as parameters showing similar characteristics.

Embodiment 2

Figure 6:
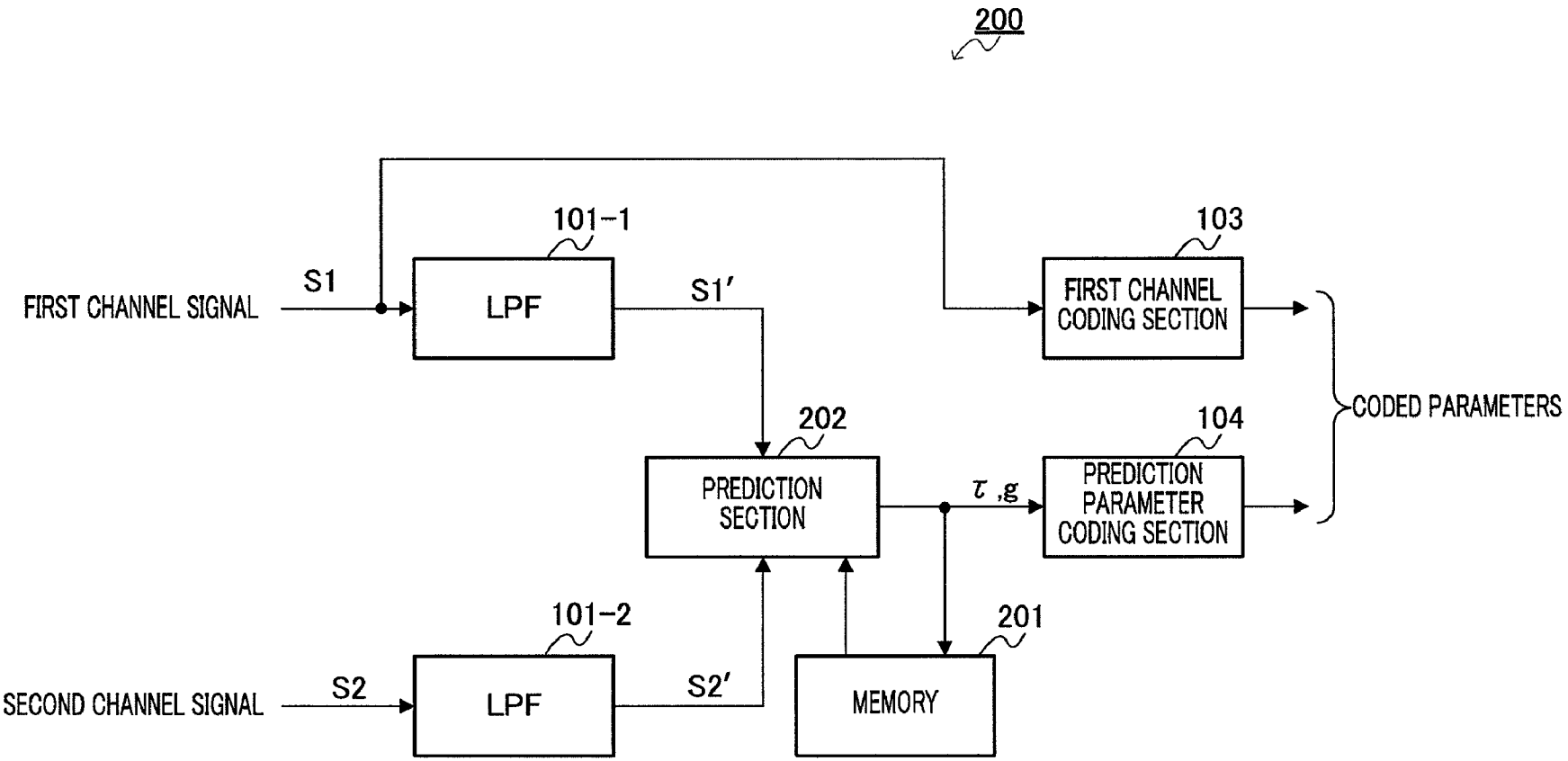
FIG. 6 is a block diagram showing the main configuration of a stereo coding apparatus according to Embodiment 2.

FIG. 6 is a block diagram showing the main configuration of stereo coding apparatus 200 according to Embodiment 2 of the present invention. Stereo coding apparatus 200 has the basic configuration similar to stereo coding apparatus 100 shown in Embodiment 1, and the same components will be assigned the same reference numerals and explanations thereof will be omitted.

Stereo coding apparatus 200 is further provided with memory 201, and prediction section 202 performs different operations from prediction section 102 according to Embodiment 1 with reference to data stored in this memory 201 as appropriate.

More specifically, memory 201 accumulates prediction parameters outputted from prediction section 202 (delay time difference τ, amplitude ratio g) for predetermined past frames (N frames) and outputs the prediction parameters to prediction section 202 as appropriate.

The prediction parameters of the past frames are inputted to prediction section 202 from memory 201. Prediction section 202 determines a search range for searching a prediction parameter in the current frame according to the values of the prediction parameters of the past frames inputted from memory 201. Prediction section 202 searches a prediction parameter within the determined search range and outputs the finally obtained prediction parameter to prediction parameter coding section 104.

Explaining the above-described processing using an equation, delay time difference τ(i) of the current frame is searched within the range shown in following equation 9 assuming that the past delay time differences are τ(i−1), τ(i−2), τ(i−3), . . . , τ(i−j) . . . , τ(i−N).

[8]

$$\min\{\tau(i-j)\} \leqq \tau(i) \leqq \max\{\tau(i-j)\} \quad \text{(Equation 9)}$$

Here, j is a value ranging from 1 to N.

Furthermore, amplitude ratio g(i) of the current frame is searched within the range shown in following equation 10 assuming that the past amplitude ratios are g(i−1), g(i−1), g(i−2), g(i−3), . . . , g(i−j), . . . , g(i−N).

[9]

$$\min\{g(i-j)\} \leqq g(i) \leqq \max\{g(i-j)\} \quad \text{(Equation 10)}$$

Here, j is a value ranging from 1 to N.

In this way, according to the present embodiment, by determining a search range for calculating a prediction parameter based on the values of prediction parameters in the past frames, more specifically, by limiting the prediction parameter of the current frame to a value in the vicinity of the prediction parameters of the past frames, it is possible to prevent extreme prediction errors from occurring and avoid deterioration of sound quality of decoded signals.

Embodiment 3

Figure 7:
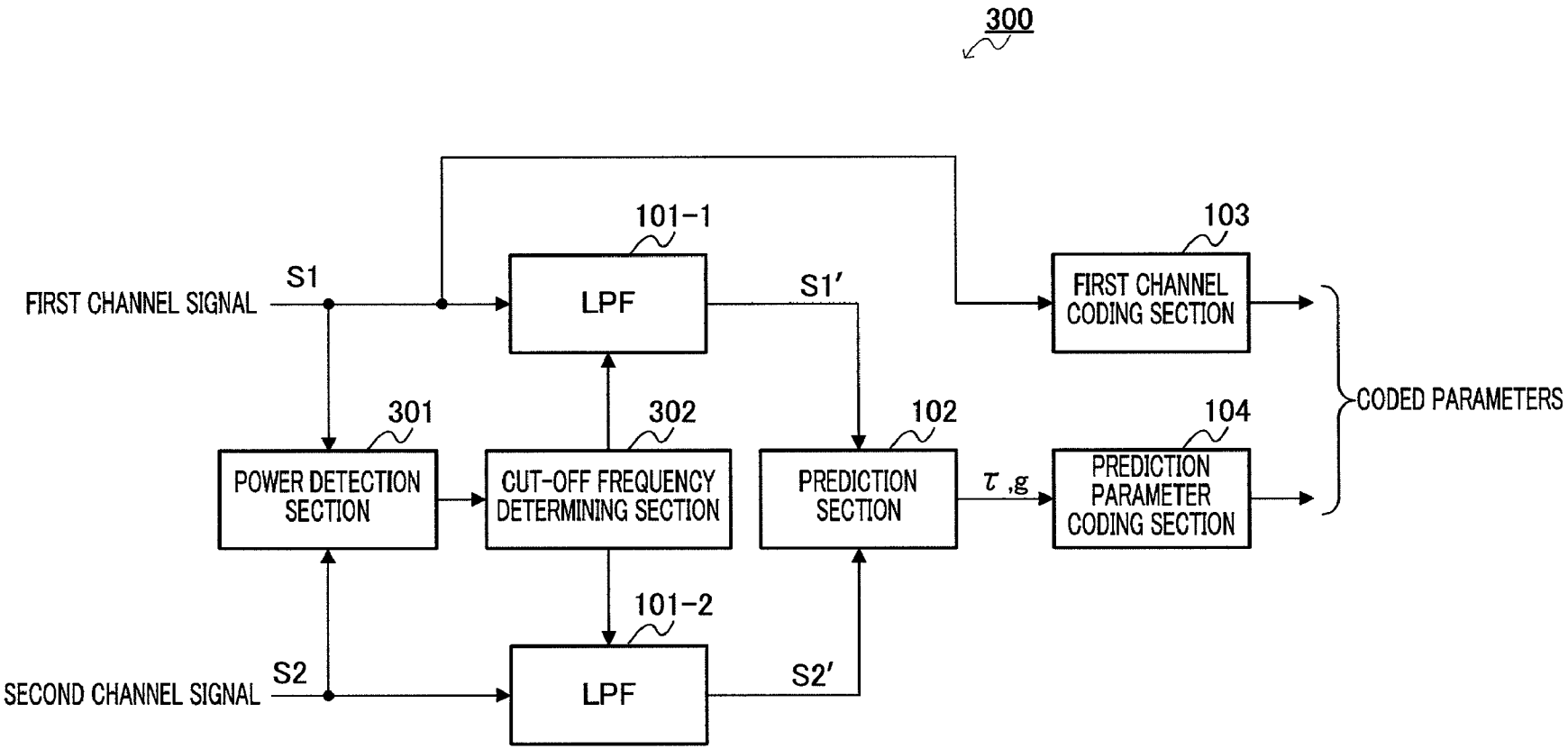
FIG. 7 is a block diagram showing the main configuration of a stereo coding apparatus according to Embodiment 3.

FIG. 7 is a block diagram showing the main configuration of stereo coding apparatus 300 according to Embodiment 3 of the present invention. Stereo coding apparatus 300 also has the basic configuration similar to stereo coding apparatus 100 shown in Embodiment 1, and the same components will be assigned the same reference numerals and explanations thereof will be omitted.

Stereo coding apparatus 300 is further provided with power detection section 301 and cut-off frequency determining section 302, and cut-off frequency determining section 302 adaptively controls cut-off frequency of LPFs 101-1 and 101-2 based on the detection result in power detection section 301.

More specifically, power detection section 301 monitors power of both first channel signal S1 and second channel signal S2 and outputs the monitoring result to cut-off frequency determining section 302. Here, a mean value for each subband is used as power.

Cut-off frequency determining section 302 averages power of first channel signal S1 for each subband over the whole band and calculates average power of the whole band. Next, cut-off frequency determining section 302 uses the calculated average power of the whole band as a threshold and compares the power of first channel signal S1 for each subband with the threshold. Cut-off frequency determining section 302 then determines cut-off frequency f1 that includes all subbands having power larger than the threshold.

Second channel signal S2 is also subjected to processing similar to that for the first channel signal S1, and cut-off frequency determining section 302 determines the value of cut-off frequency f2 of LPF 101-2. Cut-off frequency determining section 302 then determines final cut-off frequency fc common to LPFs 101-1 and 101-2 based on cut-off frequencies f1 and f2 and designates cut-off frequency fc to LPFs 101-1 and 101-2. By this means, LPFs 101-1 and 101-2 can retain all components of frequency bands having relatively large power and output such components to prediction section 102.

Normally, f1 an f2 are assumed to have the same value, and therefore cut-off frequency determining section 302 sets f1 (or f2) as final cut-off frequency fc. If f1 and f2 show different values, the cut-off frequency that allows more low-band components to remain, that is, the cut-off frequency having the greater value is adopted as fc from the standpoint of saving information safely.

In this way, according to the present embodiment, the delay time difference and amplitude ratio which are prediction parameters are calculated for signals having relatively high power, so that it is possible to improve the accuracy of calculating prediction parameters, that is, improve prediction performance.

Figure 8:
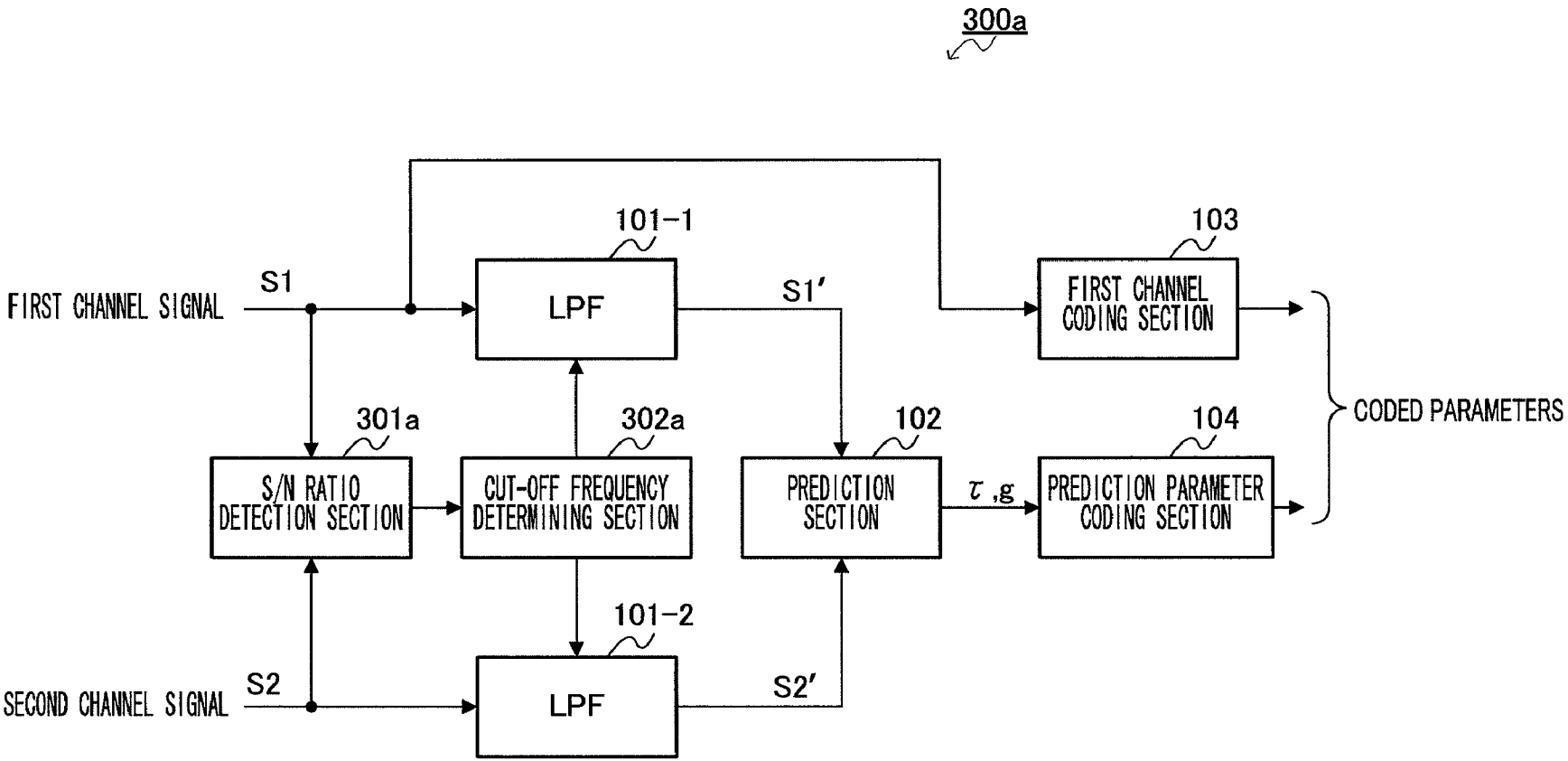
FIG. 8 is a block diagram showing the main configuration of a stereo coding apparatus according to another variation of Embodiment 3.

Although an example has been described with the present embodiment where the cut-off frequency of a low pass filter is determined based on the power of the input signal, for example, the S/N ratio for each subband of an input signal may also be used. FIG. 8 is a block diagram showing the main configuration of stereo coding apparatus 300*a* according to another variation of the present embodiment. Stereo coding apparatus 300*a* is provided with S/N ratio detection section 301*a* instead of power detection section 301 and monitors the S/N ratio for each subband of an input signal. The noise level is estimated from the input signal. Cut-off frequency determining section 302*a* determines a cut-off frequency of a low pass filter so as to include all subbands having relatively high S/N ratios, based on the monitoring result of S/N ratio detection section 301*a*. By this means, it is possible to adaptively control the cut-off frequency in a state where ambient noise exists. Thus, it is possible to calculate the delay time difference and amplitude ratio based on subbands having relatively low ambient noise level and improve the accuracy of calculating prediction parameters.

Furthermore, if the cut-off frequency per frame fluctuates discontinuously, the characteristic of a signal having passed through the low pass filter changes, and the values of $\tau$ and g also become discontinuous per frame and prediction performance deteriorates. Therefore, the cut-off frequency itself may be smoothed so that the cut-off frequency maintains continuity between frames.

Embodiment 4

Figure 9:
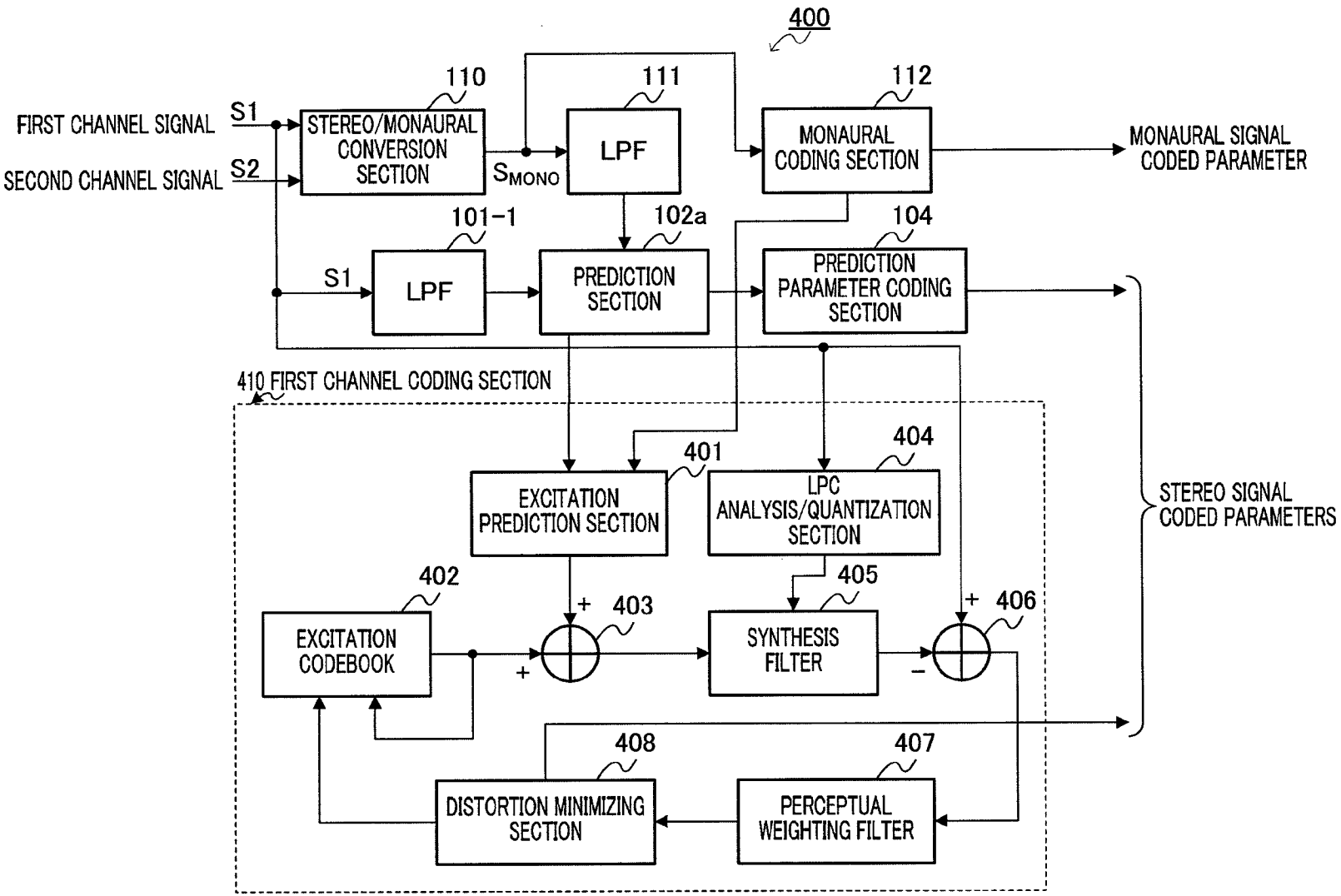
FIG. 9 is a block diagram showing the main configuration of a stereo coding apparatus according to Embodiment 4.

FIG. 9 is a block diagram showing the main configuration of stereo coding apparatus 400 according to Embodiment 4 of the present invention. Here, an example will be explained where an input signal is a speech signal and stereo coding apparatus 400 is a scalable coding apparatus that generates a coded parameter of a monaural signal and a coded parameter of a stereo signal.

Part of the configuration of stereo coding apparatus 400 is the same as stereo coding apparatus 100*a* shown in the variation of Embodiment 1 (see FIG. 4, the same components will be assigned the same reference numerals). However, the input signal is speech, and, consequently, first channel coding section 410 employing a configuration different from that of stereo coding apparatus 100*a* is designed so that a technique of CELP coding appropriate for speech coding is applicable to first channel signal coding.

More specifically, stereo coding apparatus 400 receives a first channel signal and second channel signal as input signals, performs encoding on the monaural signal in a core layer and performs encoding on the first channel signal out of the stereo signal in an enhancement layer, and outputs both the coded parameters of the monaural signal and the coded parameters of the first channel signal to the decoding side. The decoding side can decode the second channel signal using the coded parameters of the monaural signal and the coded parameters of the first channel signal.

The core layer is provided with stereo/monaural conversion section 110, LPF 111 and monaural coding section 112, and, although this configuration is basically the same as the configuration shown with stereo coding apparatus 100*a*, additionally, monaural coding section 112 outputs an excitation signal of the monaural signal obtained in the middle of encoding processing to the enhancement layer.

The enhancement layer is provided with LPF 101-1, prediction section 102*a*, prediction parameter coding section 104 and first channel coding section 410. As in the case of Embodiment 1, prediction section 102*a* predicts a low-band component of the first channel signal from a low-band component of the monaural signal and outputs the generated prediction parameter to prediction parameter coding section 104 and also outputs the prediction parameter to excitation prediction section 401.

First channel coding section 410 performs encoding by separating the first channel signal into excitation information and vocal tract information. For the excitation information, excitation prediction section 401 predicts an excitation signal of the first channel signal using the prediction parameter outputted from prediction section 102*a* and using the excitation signal of the monaural signal outputted from monaural coding section 112. In the same way as normal CELP coding, first channel coding section 410 searches an excitation using excitation codebook 402, synthesis filter 405, distortion minimizing section 408, or the like, and obtains coded parameters of the excitation information. On the other hand, as for the vocal tract information, LPC analysis/quantization section 404 performs linear predictive analysis on the first channel signal and quantization on the analysis result, obtains a coded parameter of the vocal tract information and uses the coded parameter to generate a synthesis signal at synthesis filter 405.

In this way, according to the present embodiment, stereo/monaural conversion section 110 generates a monaural signal from the first channel signal and second channel signal, LPF 111 cuts off a high-band component of the monaural signal and generates a monaural low-band component. Prediction section 102*a* then predicts the low-band component of the first channel signal from the low-band component of the monaural signal through the processing similar to that in Embodiment 1, obtains a prediction parameter, performs encoding on the first channel signal using the prediction parameter according to a method compatible with CELP coding and obtains coded parameters of the first channel signal. The coded parameters of this first channel signal together with the coded parameters of the monaural signal are outputted to the decoding side. With this configuration, it is possible to realize a monaural-stereo scalable coding apparatus, improve prediction performance of a stereo signal between channels and improve sound quality of decoded signals.

Embodiment 5

Figure 10:
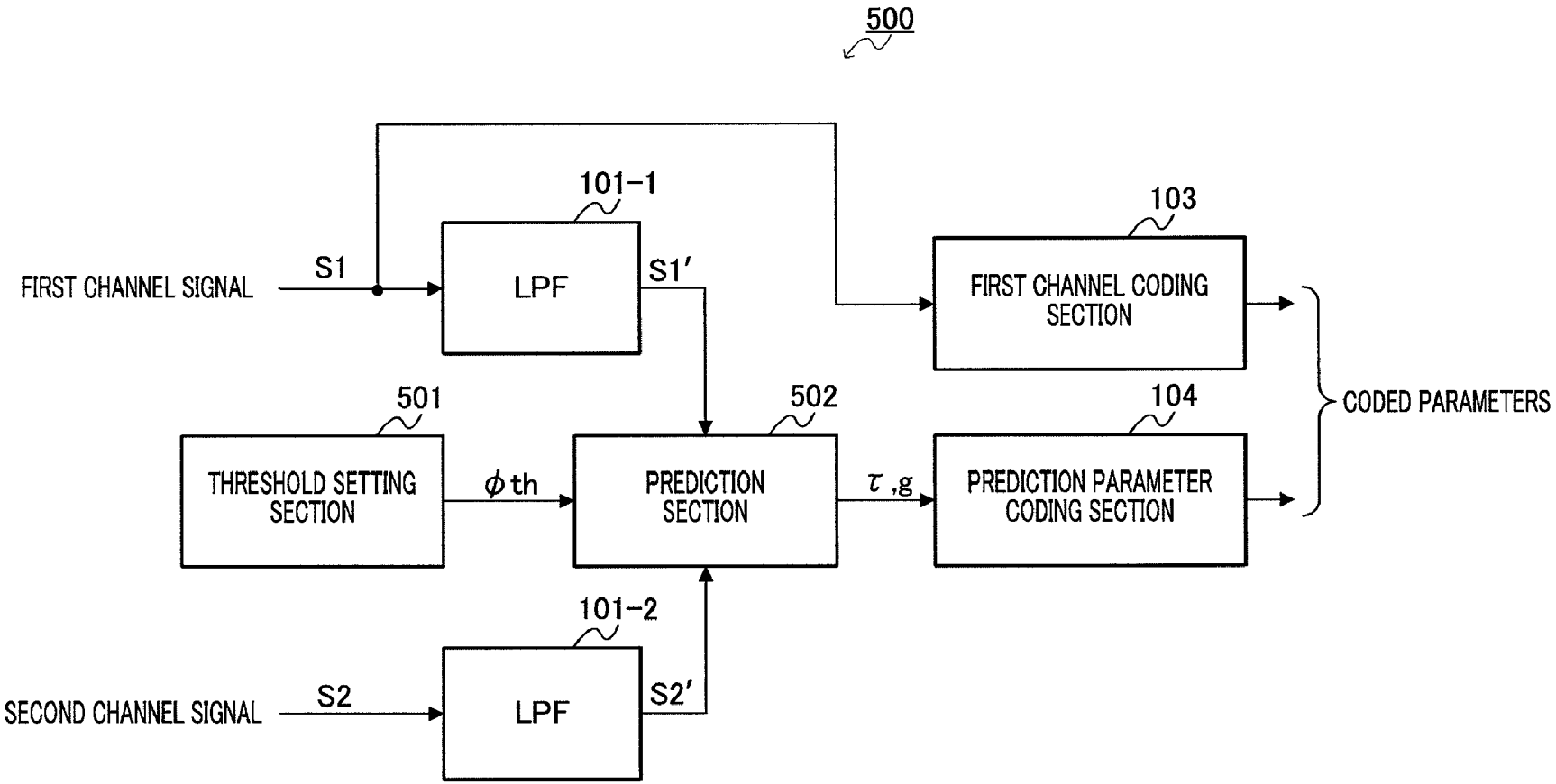
FIG. 10 is a block diagram showing the main configuration of a stereo coding apparatus according to Embodiment 5.

FIG. 10 is a block diagram showing the main configuration of stereo coding apparatus 500 according to Embodiment 5 of the present invention. Stereo coding apparatus 500 also has the basic configuration similar to that of stereo coding apparatus 100 shown in Embodiment 1, and the same components will be assigned the same reference numerals and explanations thereof will be omitted.

Stereo coding apparatus 500 is provided with threshold setting section 501 and prediction section 502, and prediction section 502 decides the reliability of this cross-correlation function by comparing threshold $\phi_{th}$ preset in threshold setting section 501 with the value of cross-correlation function $\phi$.

More specifically, prediction section 502 calculates cross-correlation function $\phi$ expressed by following equation 11 using low-band component S1' of the first channel signal having passed through LPF 101-1 and low-band component S2' of the second channel signal having passed through LPF 101-2,

[10]

$$\phi(m) = \frac{\sum_{n=0}^{FL-1} S1'(n) \cdot S2'(n-m)}{\sqrt{\sum_{n=0}^{FL-1} S1'(n)^2} \sqrt{\sum_{n=0}^{FL-1} S2'(n-m)^2}} \quad \text{(Equation 11)}$$

where, cross-correlation function $\phi$ is assumed to be normalized with the autocorrelation function of each channel signal. Furthermore, n and m are sample numbers and FL is a frame length (number of samples). As is apparent from equation 11, the maximum value of $\phi$ is 1.

Figure 11:
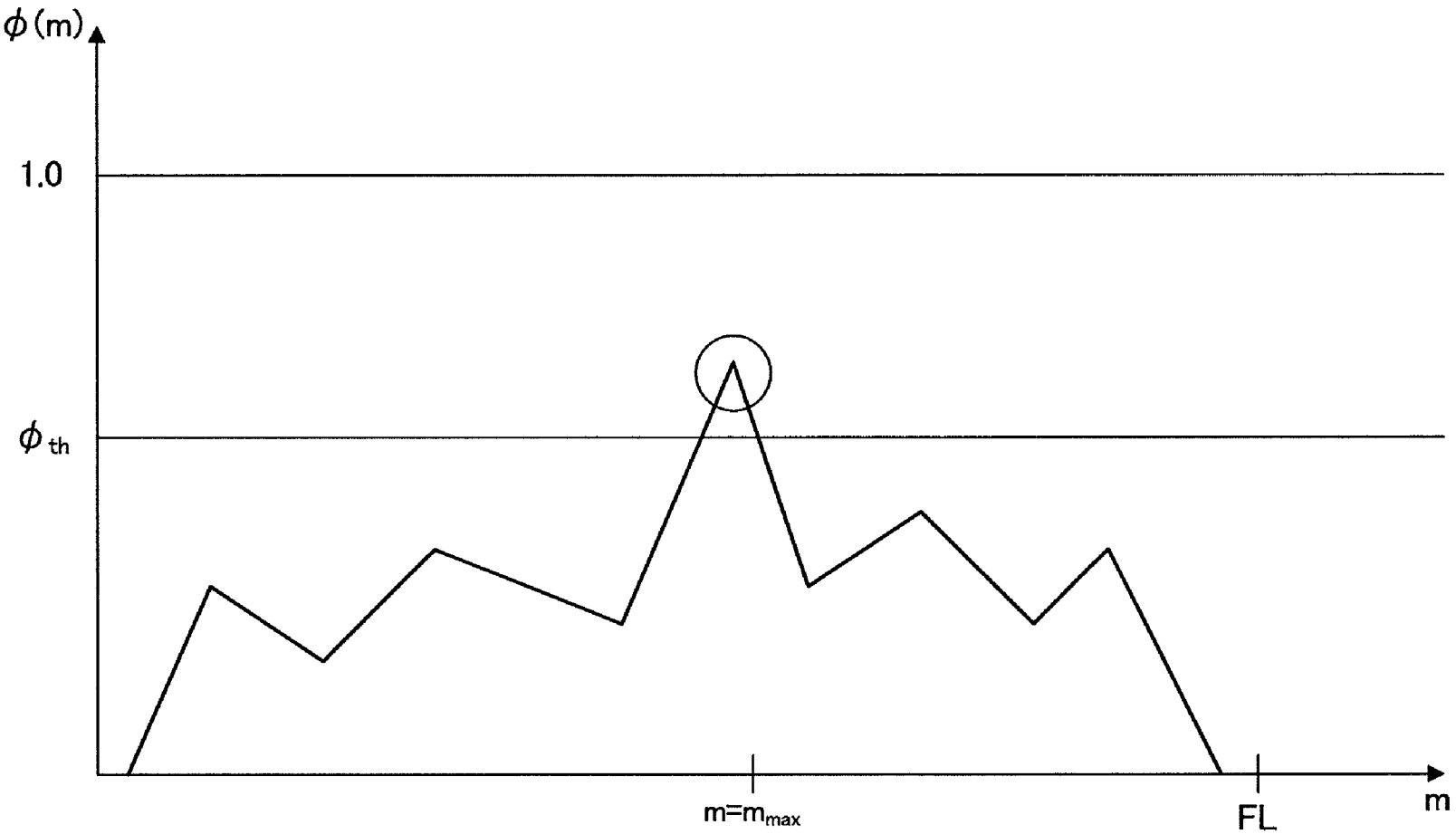
FIG. 11 shows an example of a cross-correlation function.

Prediction section 502 then compares threshold $\phi_{th}$ preset in threshold setting section 501 with the maximum value of cross-correlation function $\phi$ and, when this is equal to or greater than the threshold, decides that this cross-correlation function is reliable. In other words, prediction section 502 compares threshold $\phi_{th}$ preset in threshold setting section 501 with sample values of cross-correlation function $\phi$, and, when there is at least one sample point which is equal to or greater than the threshold, decides that this cross-correlation function is reliable. FIG. 11 shows an example of cross-correlation function $\phi$. This is an example where the maximum value of the cross-correlation function exceeds the threshold.

In such a case, prediction section 502 calculates delay time difference $\tau$ between low-band component S1' of the first channel signal and low-band component S2' of the second channel signal as $m=m_{max}$ that maximizes the value of the cross-correlation function expressed by above-described equation 11.

Figure 12:
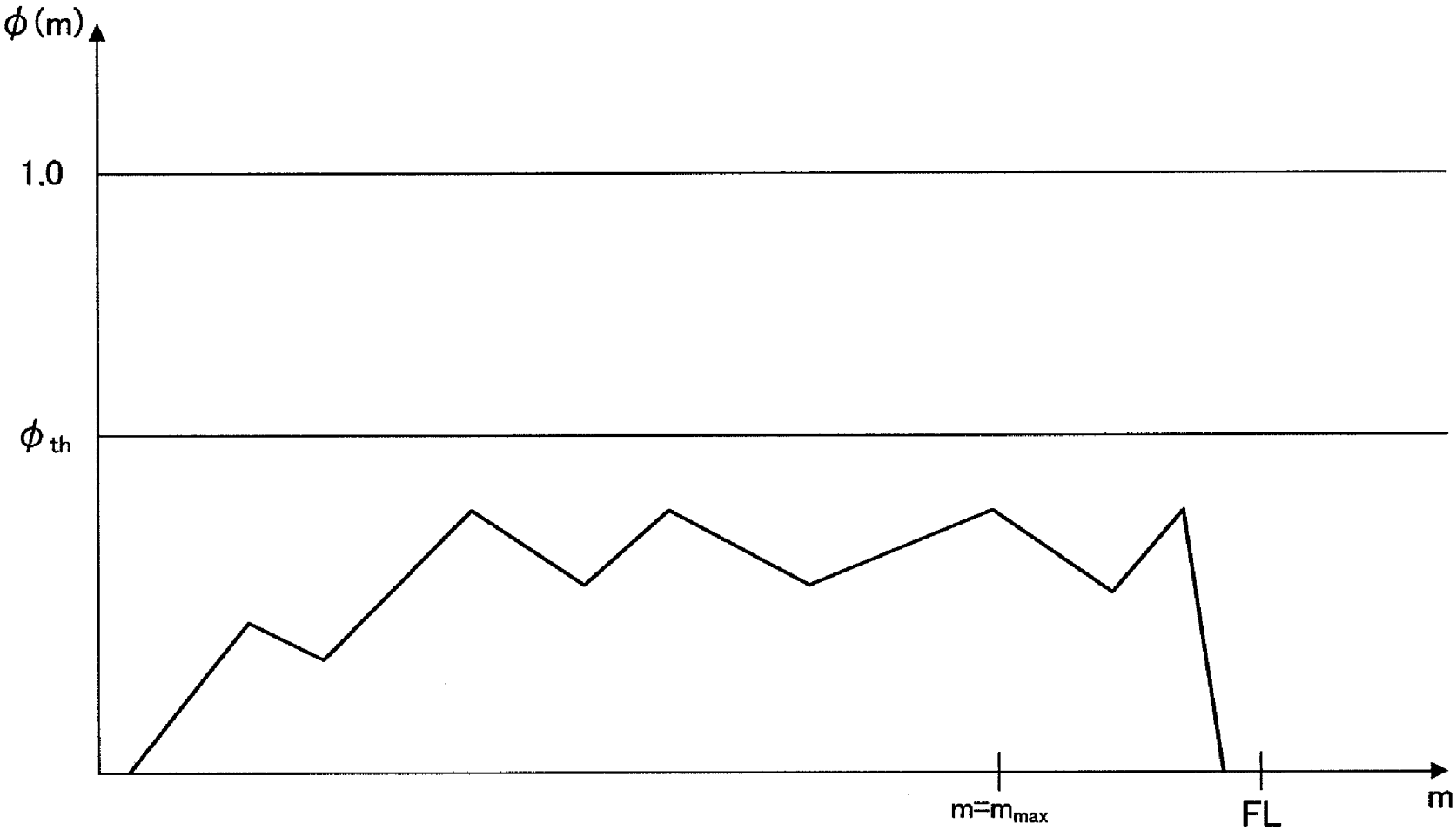
FIG. 12 shows an example of a cross-correlation function.

On the other hand, when the maximum value of cross-correlation function $\phi$ does not reach threshold $\phi_{th}$, prediction section 502 determines delay time difference $\tau$ already determined in the previous frame as delay time difference $\tau$ of the frame. FIG. 12 also shows an example of cross-correlation function $\phi$. Here, an example is shown where the maximum value of the cross-correlation function does not exceed the threshold.

Prediction section 502 calculates amplitude ratio g using a method similar to that of Embodiment 1.

In this way, according to the present embodiment, to calculate delay time difference $\tau$ with high reliability, whether or not the value of the cross-correlation function is reliable is decided, and then the value of delay time difference $\tau$ is determined. More specifically, the cross-correlation function normalized with the autocorrelation function of each channel signal is used as the cross-correlation function upon calculating the delay time difference, a threshold is provided in advance, and, when the maximum value of the cross-correlation function is equal to or greater than the threshold, $m=m_{max}$ that maximizes the value of the cross-correlation function is determined as the delay time difference. On the other hand, when the cross-correlation function does not reach the threshold at all, the delay time difference determined in the previous frame is determined as the delay time difference of the frame. With this configuration, it is possible to calculate a delay time difference accurately.

Embodiment 6

Figure 13:
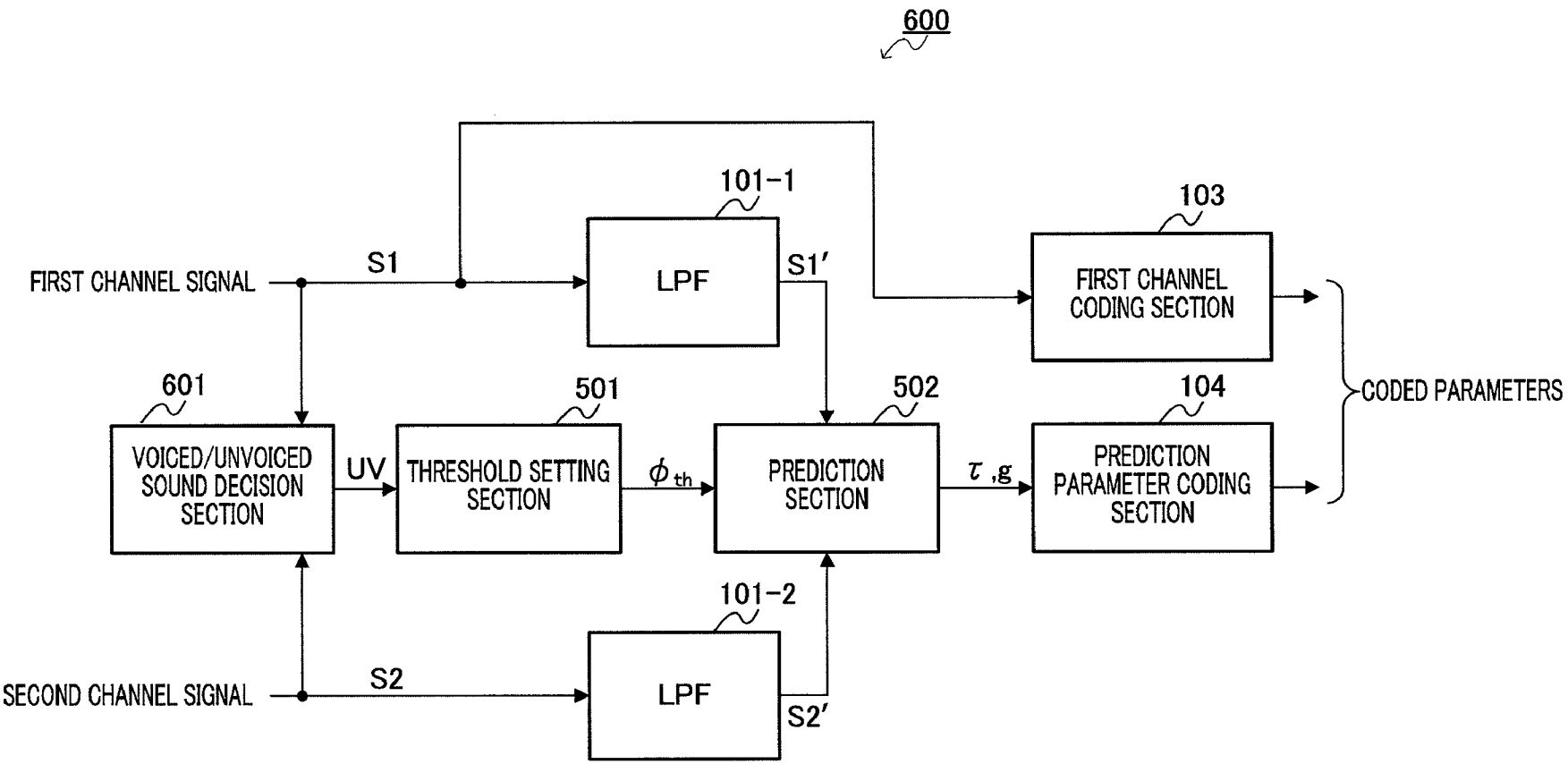
FIG. 13 is a block diagram showing the main configuration of a stereo coding apparatus according to Embodiment 6.

FIG. 13 is a block diagram showing the main configuration of stereo coding apparatus 600 according to Embodiment 6 of the present invention. Stereo coding apparatus 600 has the basic configuration similar to that of stereo coding apparatus 500 shown in Embodiment 5, and the same components will be assigned the same reference numerals and explanations thereof will be omitted.

Stereo coding apparatus 600 is further provided with voiced/unvoiced sound decision section 601, which decides whether a first channel signal and a second channel signal not having passed through low pass filters are voiced sound or unvoiced sound to set a threshold in threshold setting section 501.

More specifically, voiced/unvoiced sound decision section 601 calculates the value of autocorrelation function $\phi_{SS}$ using first channel signal S1 and second channel signal S2 according to following equation 12.

[11]

$$\phi_{SS}(m) = \frac{\sum_{n=0}^{FL-1} S(n)\cdot S(n-m)}{\sqrt{\sum_{n=0}^{FL-1} S(n)^2}\sqrt{\sum_{n=0}^{FL-1} S(n-m)^2}} \quad \text{(Equation 12)}$$

Here, S(n) is a first channel signal or second channel signal, n and mare sample numbers and FL is a frame length (number of samples). As is apparent from equation 12, the maximum value of $\phi_{SS}$ is 1.

A threshold for deciding voiced/unvoiced sound is preset in voiced/unvoiced sound decision section 601. Voiced/unvoiced sound decision section 601 compares the value of autocorrelation function $\phi_{SS}$ of the first channel signal or second channel signal with the threshold, decides that the signal is a voiced sound when the value exceeds the threshold and decides that the signal is not a voiced sound (that is, an unvoiced sound) when the value does not exceed the threshold. That is, a decision on voiced/unvoiced sound is made for both the first channel signal and second channel signal. Voiced/unvoiced sound decision section 601 then takes into consideration the values of autocorrelation function $\phi_{SS}$ of the first channel signal and autocorrelation function $\phi_{SS}$ of the second channel signal by, for example, calculating a mean value thereof and decides whether these channel signals are voiced or unvoiced sounds. The decision result is outputted to threshold setting section 501.

Threshold setting section 501 changes the threshold setting depending on whether the channel signals are decided as voiced or not decided as voiced sound. More specifically, threshold setting section 501 sets threshold $\phi_V$ used in the case of voiced sound smaller than threshold $\phi_{UV}$ used in the case of unvoiced sound. The reason is that periodicity exists in the case of voiced sound, and, consequently, there is a large difference between the value of the cross-correlation function which has a local peak and other values of the cross-correlation function which do not have local peaks. On the other hand, no periodicity exists in the case of unvoiced sound (because it is noise-like sound), and, consequently, the difference between the value of the cross-correlation function which has a local peak and other values of the cross-correlation function which do not have local peaks is not large.

Figure 14:
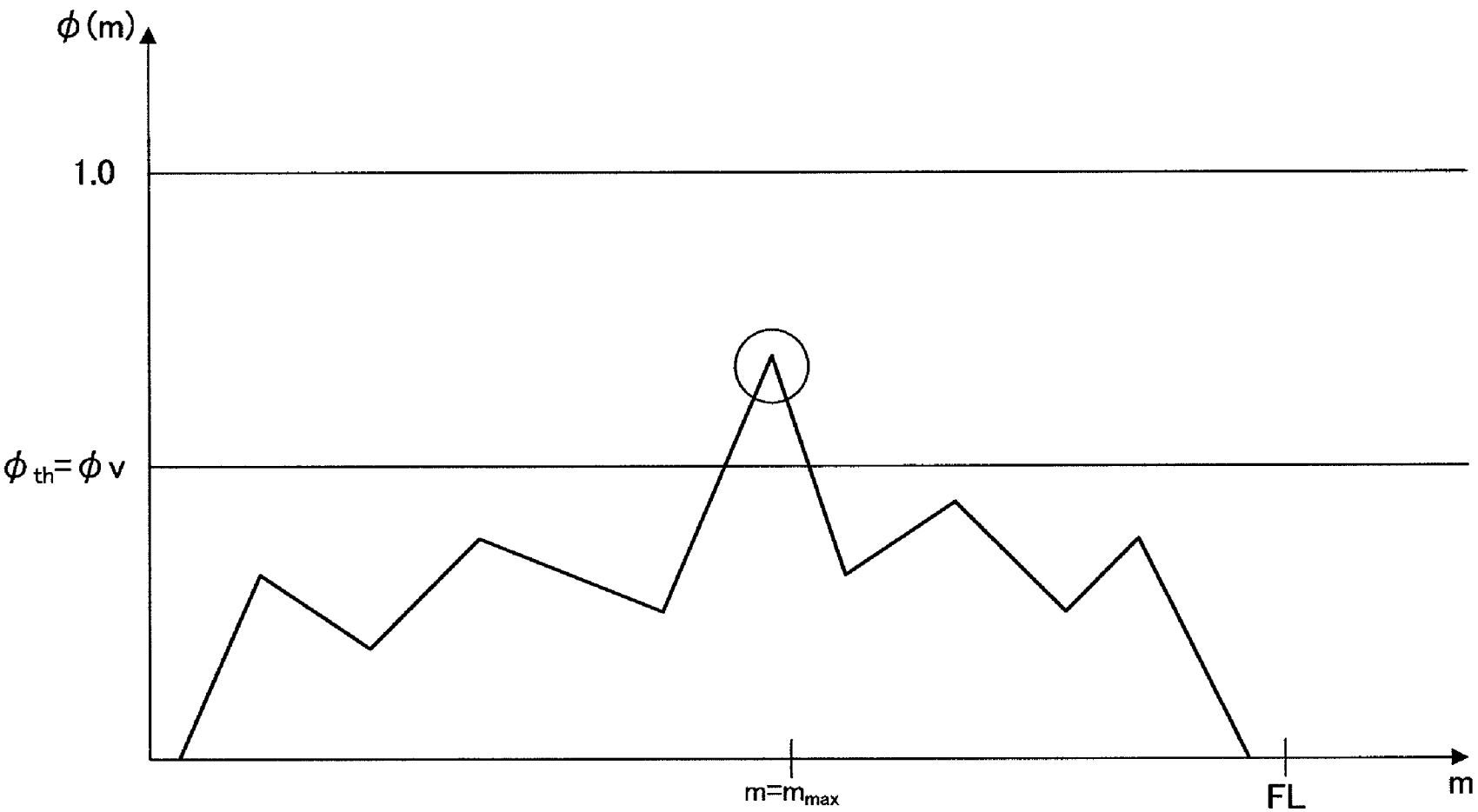
FIG. 14 shows an example of the cross-correlation function in the case of voiced sound.
Figure 15:
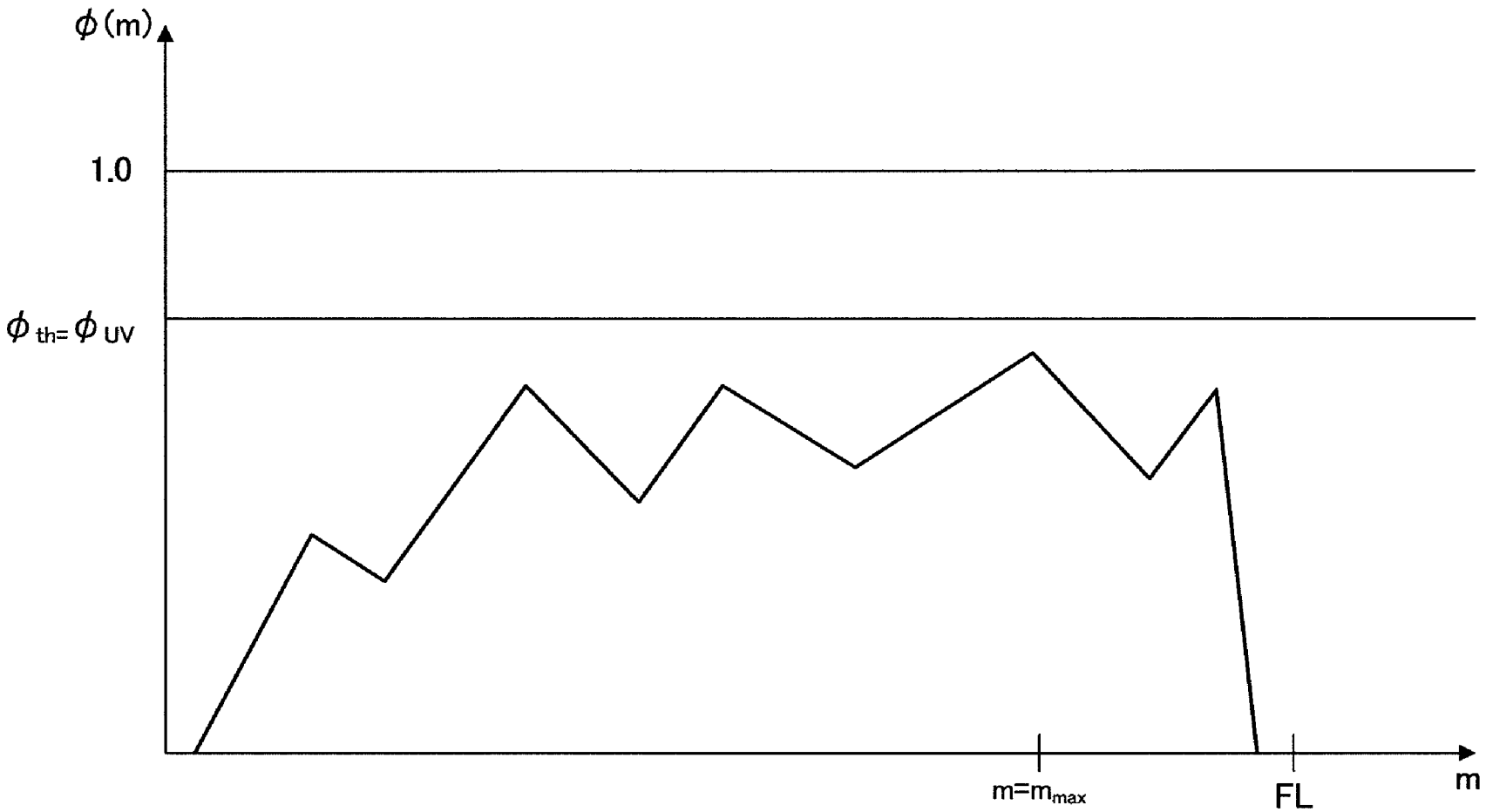
FIG. 15 shows an example of the cross-correlation function in the case of unvoiced sound.

FIG. 14 shows an example of the cross-correlation function in the case of voiced sound. Furthermore, FIG. 15 shows an example of the cross-correlation function in the case of unvoiced sound. Both figures show the threshold as well. As shown in this figure, the cross-correlation function has different aspects between voiced sound and unvoiced sound, and, consequently, a threshold is set so as to adopt a value of a reliable cross-correlation function, and the method of setting the threshold is changed depending on whether a signal has a voiced sound property or an unvoiced sound property. That is, by setting a greater threshold of the cross-correlation function for a signal judged to have an unvoiced sound property, the signal is not adopted as a delay time difference unless there is a large difference between the value of the cross-correlation function and values of other cross-correlation functions which do not become local peaks, so that it is possible to improve the reliability of the cross-correlation function.

In this way, according to the present embodiment, by deciding voiced/unvoiced sound using the first channel signal and second channel signal not having passed through the low pass filter, the threshold for deciding the reliability of the cross-correlation function is changed depending on whether the signal is a voiced sound or unvoiced sound. More specifically, a smaller threshold is set for voiced sound than for unvoiced sound. Therefore, it is possible to determine the delay time difference more accurately.

Embodiment 7

Figure 16:
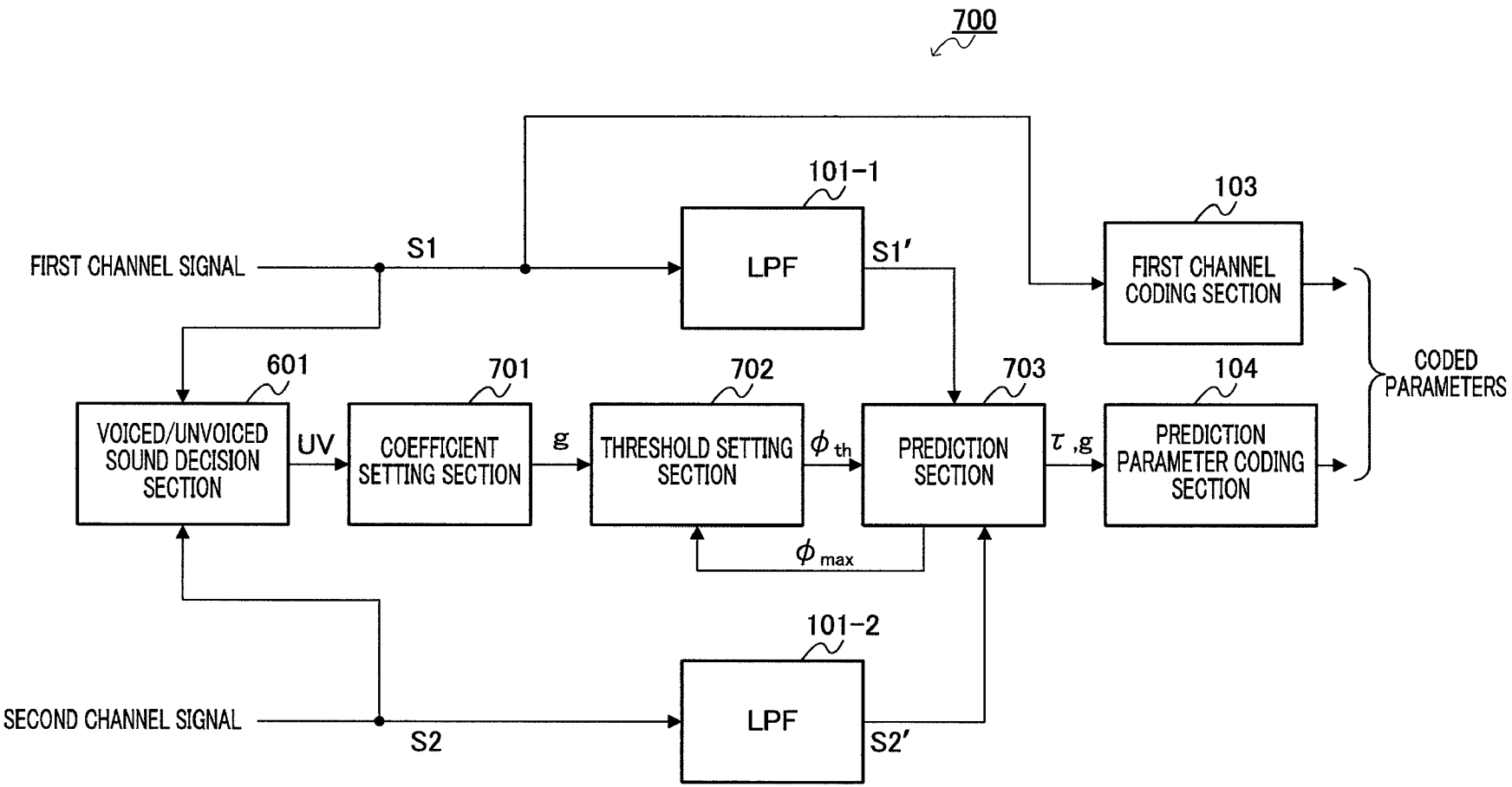
FIG. 16 is a block diagram showing the main configuration of a stereo coding apparatus according to Embodiment 7.

FIG. 16 is a block diagram showing the main configuration of stereo coding apparatus 700 according to Embodiment 7 of the present invention. Stereo coding apparatus 700 has the basic configuration similar to that of stereo coding apparatus 600 shown in Embodiment 6, and the same components will be assigned the same reference numerals and explanations thereof will be omitted.

Stereo coding apparatus 700 is provided with coefficient setting section 701, threshold setting section 702, and prediction section 703 after voiced/unvoiced sound decision section 601, and multiplies a maximum value of a cross-correlation function by a coefficient according to a voiced/unvoiced decision result and determines a delay time difference using the maximum value of the cross-correlation function having multiplied by this coefficient.

More specifically, coefficient setting section 701 sets coefficient g which varies depending on whether the signal is voiced or unvoiced sound based on the decision result outputted from voiced/unvoiced sound decision section 601 and outputs coefficient g to threshold setting section 702. Here, coefficient g is set a positive value less than 1 based on the maximum value of the cross-correlation function. Furthermore, greater coefficient $g_V$ is set in the case of voiced sound than coefficient $g_{UV}$ in the case of unvoiced sound. Threshold setting section 702 sets a value obtained by multiplying maximum value $\phi_{max}$ of the cross-correlation function by coefficient g as threshold $\phi_{th}$ and outputs the set value to prediction section 703. Prediction section 703 detects local peaks whose apices are included in the area between this threshold $\phi_{th}$ and maximum value $\phi_{max}$ of the cross-correlation function.

Figure 17:
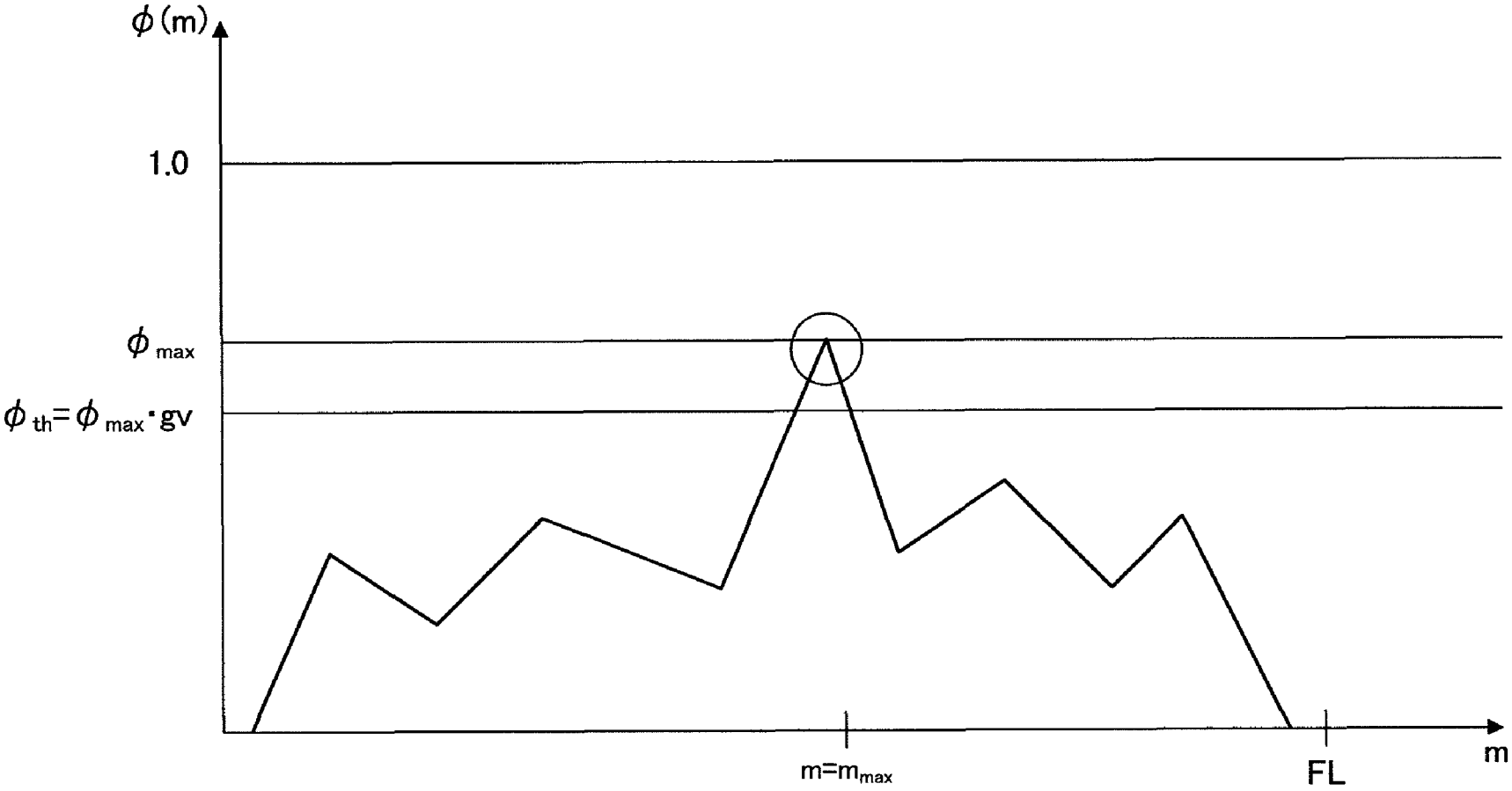
FIG. 17 shows an example of the cross-correlation function in the case of voiced sound.
Figure 18:
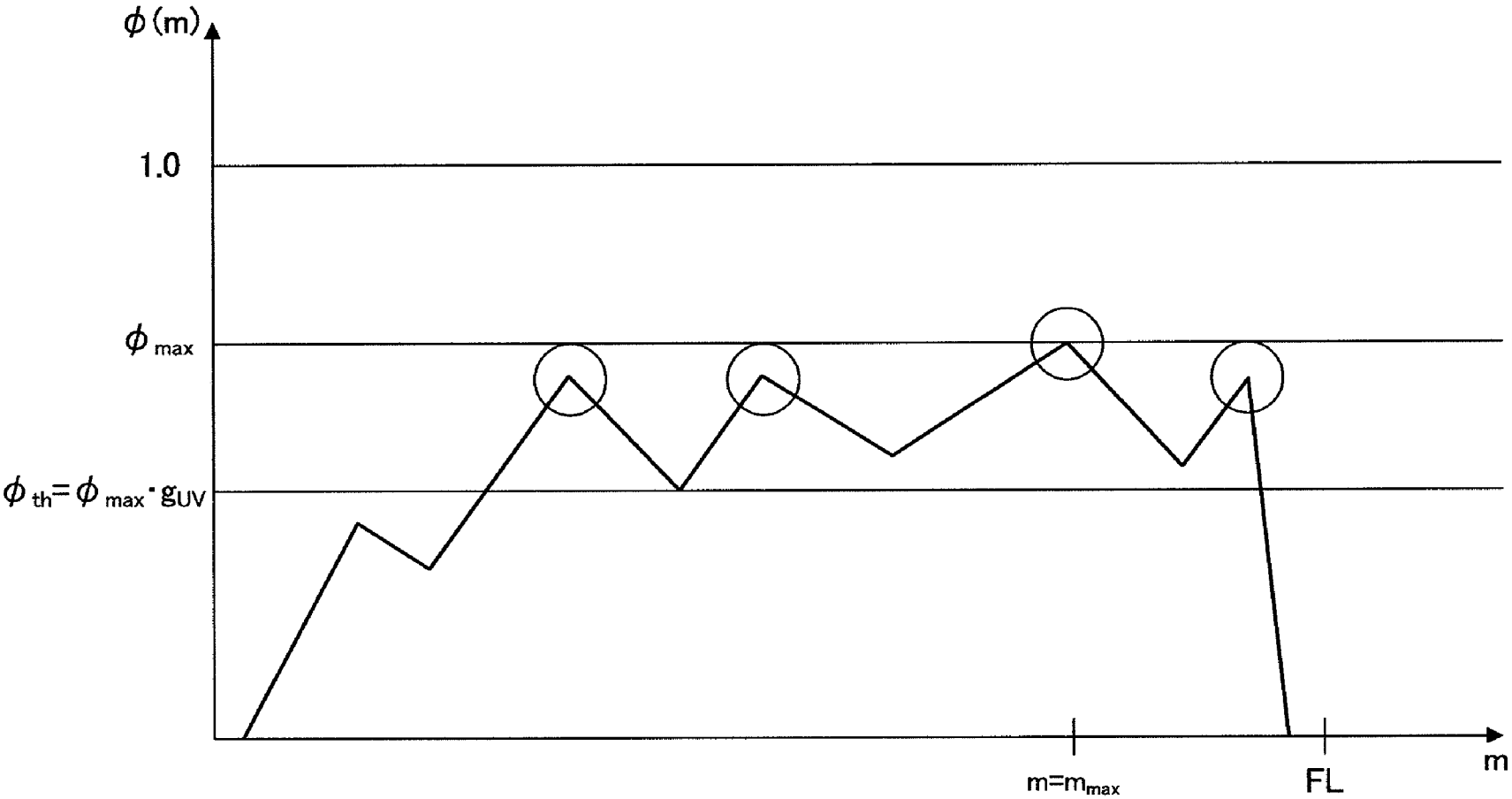
FIG. 18 shows an example of the cross-correlation function in the case of unvoiced sound.

FIG. 17 shows an example of the cross-correlation function in the case of voiced sound. Furthermore, FIG. 18 shows an example of the cross-correlation function in the case of unvoiced sound. Both figures show thresholds as well. Prediction section 703 detects local peaks of the cross-correlation function whose apices exist in the area between maximum value $\phi_{max}$ and threshold $\phi_{th}$, and, unless local peaks other than the peaks (encircled peaks in the figure) showing maximum values are detected, decides $m=m_{max}$ that maximizes the value of the cross-correlation function as a delay time difference. For example, in the example of FIG. 17, only one local peak exists in the area between $\phi_{max}$ and $\phi_{th}$, and $m=m_{max}$ is adopted as delay time difference $\tau$. On the other hand, if local peaks other than the peaks showing the maximum values are detected, the delay time difference of the previous frame is determined as the delay time difference of the frame. For example, in the example of FIG. 18, four local peaks (encircled peaks in the figure) exist in the area between $\phi_{max}$ and $\phi_{th}$, and, consequently, $m=m_{max}$ is not adopted as delay time difference $\tau$ and the delay time difference of the previous frame is adopted as the delay time difference of the frame.

The reason for setting different thresholds by changing the coefficient between voiced sound and unvoiced sound, is that there is periodicity in the case of voiced sound, which causes a large difference between the value of the cross-correlation function which normally has a local peak and other values of the cross-correlation function which do not have local peaks, and therefore only the vicinity of maximum value $\phi_{max}$ needs to be checked. On the other hand, in the case of unvoiced sound, there is no periodicity (noise-like sound), the difference between the value of the cross-correlation function which has a local peak and other values of the cross-correlation function which do not have local peaks is not large, and therefore it is necessary to check whether or not there is a sufficient difference between maximum value $\phi_{max}$ and other local peaks.

In this way, according to the present embodiment, a maximum value of the cross-correlation function is used as a standard and a value obtained by multiplying the maximum value by a positive coefficient less than 1 is used as a threshold. Here, the value of the coefficient to be multiplied varies depending on whether the signal is voiced or unvoiced sound (the value is made greater for voiced sound than for unvoiced sound). Local peaks existing between the maximum value of the cross-correlation function and the threshold are detected, and, if any local peak other than the peak showing the maximum value is not detected, the value of $m=m_{max}$ that maximizes the value of the cross-correlation function is determined as the delay time difference. On the other hand, if any local peak other than the peak showing the maximum value is detected, the delay time difference of the previous frame is determined as the delay time difference of the frame. That is, based on the maximum value of the cross-correlation function, the delay time difference is set according to the number of local peaks included in a predetermined range from the maximum value of the cross-correlation function. The delay time difference can be determined accurately by employing such a configuration.

Embodiment 8

Figure 19:
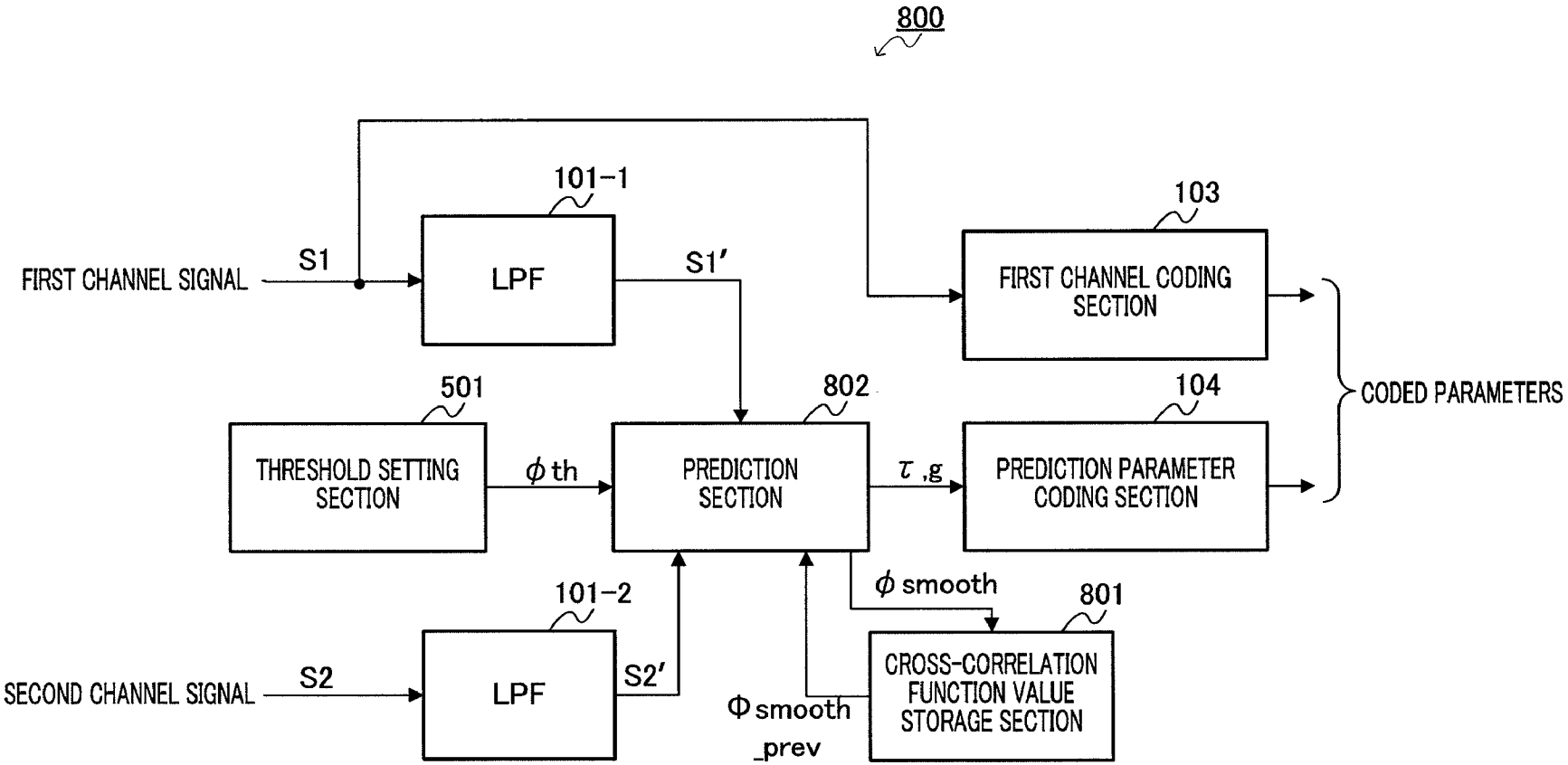
FIG. 19 is a block diagram showing the main configuration of a stereo coding apparatus according to Embodiment 8.

FIG. 19 is a block diagram showing the main configuration of stereo coding apparatus 800 according to Embodiment 8 of the present invention. Stereo coding apparatus 800 has the basic configuration similar to that of stereo coding apparatus 500 shown in Embodiment 5, and the same components will be assigned the same reference numerals and explanations thereof will be omitted.

Stereo coding apparatus 800 is further provided with cross-correlation function value storage section 801, and prediction section 802 performs different operations from prediction section 502 according to Embodiment 5 with reference to cross-correlation function values stored in this cross-correlation function value storage section 801.

More specifically, cross-correlation function value storage section 801 accumulates smoothed maximum cross-correlation values outputted from prediction section 802 and outputs the maximum cross-correlation values to prediction section 802 as appropriate.

Prediction section 802 compares threshold $\phi_{th}$ preset in threshold setting section 501 with the maximum value of cross-correlation function $\phi$, and, when this is equal to or greater than the threshold, decides that this cross-correlation function is reliable. In other words, prediction section 802 compares threshold $\phi_{th}$ preset in threshold setting section 501 with sample values of cross-correlation function $\phi$, and, when there is at least one sample point which is equal to or greater than the threshold, decides that this cross-correlation function is reliable.

In such a case, prediction section 802 calculates delay time difference $\tau$ between low-band component S1' of a first channel signal and low-band component S2' of a second channel signal as $m=m_{max}$ that maximizes the value of the cross-correlation function expressed by equation 12 described above.

On the other hand, when the maximum value of cross-correlation function $\phi$ does not reach threshold $\phi_{th}$, prediction section 802 determines delay time difference $\tau$ using the smoothed maximum cross-correlation value of the previous frame outputted from cross-correlation function value storage section 801. The smoothed maximum cross-correlation value is expressed by following equation 13.

[12]

$$\phi_{smooth}=\phi_{smooth_prev}\cdot\alpha+\phi_{max}\cdot(1-\alpha) \quad \text{(Equation 13)}$$

Here, $\phi_{smooth_prev}$ is a smoothed maximum cross-correlation value of the previous frame, $\phi_{max}$ is a maximum cross-correlation value of the current frame and $\alpha$ is a smoothing coefficient and a constant that satisfies $0<\alpha<1$.

Further, smoothed maximum cross-correlation values accumulated in cross-correlation function value storage section 801 are used as $\phi_{smooth_prev}$ upon determining the delay time difference of the next frame.

More specifically, when the maximum value of cross-correlation function $\phi$ does not reach threshold $\phi_{th}$, prediction section 802 compares smoothed maximum cross-correlation value $\phi_{smooth_prev}$ of the previous frame with preset threshold $\phi_{th_smooth_prev}$. As a result, when $\phi_{smooth_prev}$ is greater than $\phi_{th_smooth_prev}$, the delay time difference of the previous frame is determined as delay time difference $\tau$ of the current frame. On the contrary, when $\phi_{smooth_prev}$ does not exceed $\phi_{th_smooth_prev}$, the delay time difference of the current frame is set 0.

Prediction section 802 calculates amplitude ratio g using a method similar to that of Embodiment 1.

In this way, according to the present embodiment, when the maximum cross-correlation value of the current frame is low, the obtained delay time difference has also low reliability, and, consequently, by using as a substitute, a delay time difference of the previous frame having higher reliability decided using the smoothed maximum cross-correlation value in the previous frame, it is possible to determine the delay time difference more accurately.

Embodiment 9

Figure 20:
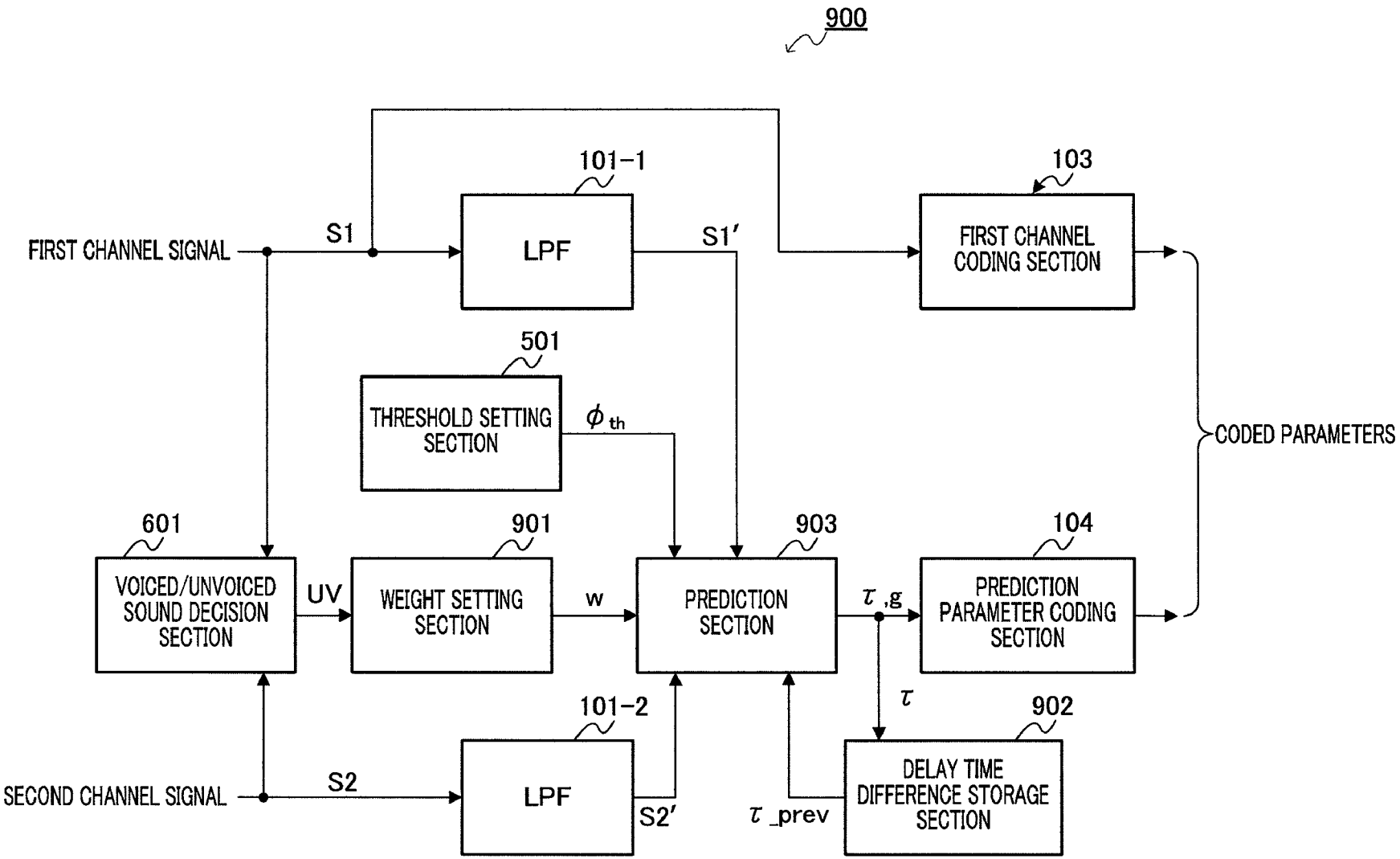
FIG. 20 is a block diagram showing the main configuration of a stereo coding apparatus according to Embodiment 9.

FIG. 20 is a block diagram showing the main configuration of stereo coding apparatus 900 according to Embodiment 9 of the present invention. Stereo coding apparatus 900 has the basic configuration similar to that of stereo coding apparatus 600 shown in Embodiment 6, and the same components will be assigned the same reference numerals and explanations thereof will be omitted.

Stereo coding apparatus 900 is further provided with weight setting section 901 and delay time difference storage section 902, and weight setting section 901 outputs weights according to voiced/unvoiced sound decision result of a first channel signal and second channel signal, and prediction section 903 performs different operations from prediction section 502 according to Embodiment 6 using this weight and the delay time difference stored in delay time difference storage section 902.

Weight setting section 901 changes weight w (>1.0) depending on whether voiced/unvoiced sound decision section 601 decides voiced sound or unvoiced sound. More specifically, weight setting section 901 sets larger weight w in the case of unvoiced sound than weight w in the case of voiced sound.

The reason is that, in the case of voiced sound, there is periodicity, and so the difference between the maximum value of the cross-correlation function and other values of the cross-correlation function at local peaks is relatively large and the amount of shift showing the maximum cross-correlation value shows a correct delay difference with high reliability, while, in the case of unvoiced sound, there is no periodicity (noise-like sound), and so the difference between the maximum value of the cross-correlation function and other values of the cross-correlation function at local peaks is relatively small, and the amount of shift showing the maximum cross-correlation value does not always show a correct delay difference. Therefore, a more accurate delay difference can be obtained by setting larger weight w in the case of unvoiced sound and making the delay difference of the previous frame easier to select.

Delay time difference storage section 902 accumulates delay time difference $\tau$ outputted from prediction section 903 and outputs this to prediction section 903 as appropriate.

Prediction section 903 determines a delay difference using weight w set by weight setting section 901 as follows. First, a candidate of delay time difference $\tau$ between low-band component S1' of the first channel signal having passed through LPF 101-1 and low-band component S2' of the second channel signal having passed through LPF 101-2 is determined as $m=m_{max}$ that maximizes the value of the cross-correlation function expressed by equation 11 above. The cross-correlation function is normalized with the autocorrelation function of each channel signal.

In equation 11, n is a sample number and FL is a frame length (number of samples). Furthermore, m is the amount of shift.

Here, when the difference between the value of m and the value of the delay time difference of the previous frame stored in delay time difference storage section 902 is within a preset range, prediction section 903 multiplies the cross-correlation value obtained by equation 11 described above by the weight set by weight setting section 901 as shown in following equation 14. The preset range is set based on delay time difference $\tau_{prev}$ in the previous frame stored in delay time difference storage section 902.

[13]

$$\phi_w(m)=w\times\phi(m) \quad \text{(Equation 14)}$$

On the other hand, when the value of m is outside the preset range, the expression becomes as following equation 15.

[14]

$$\phi_w(m)=\phi(m) \quad \text{(Equation 15)}$$

The reliability of the candidate of the delay time difference $\tau$ obtained in this way is judged by maximum value (maximum cross-correlation value) $\phi_{max}$ of the cross-correlation function expressed by above-described equation 14 and above-described equation 15 and final delay time difference $\tau$ is determined. More specifically, threshold $\phi_{th}$ preset in threshold setting section 501 is compared with maximum cross-correlation value $\phi_{max}$, and, if maximum cross-correlation value $\phi_{max}$ is equal to or greater than threshold $\phi_{th}$, this cross-correlation function is judged to be reliable, and $m=m_{max}$ that maximizes the value of the cross-correlation function is determined as delay time difference $\tau$.

Figure 21:
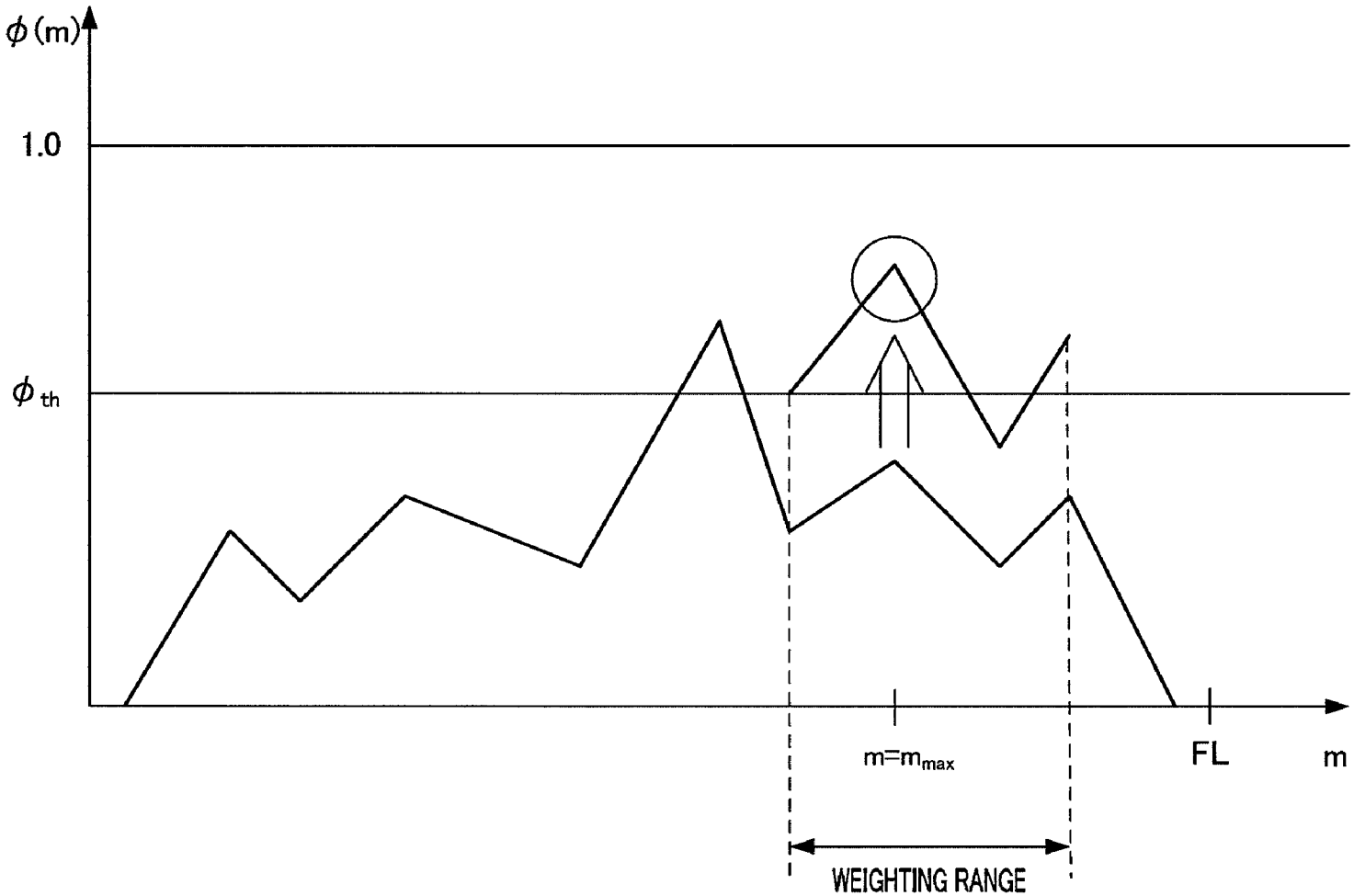
FIG. 21 shows an example of a case where a local peak of a cross-correlation function is weighted and thereby becomes a maximum cross-correlation value.

FIG. 21 shows an example of a case where a local peak of the cross-correlation function is weighted and thereby becomes a maximum cross-correlation value.

Figure 22:
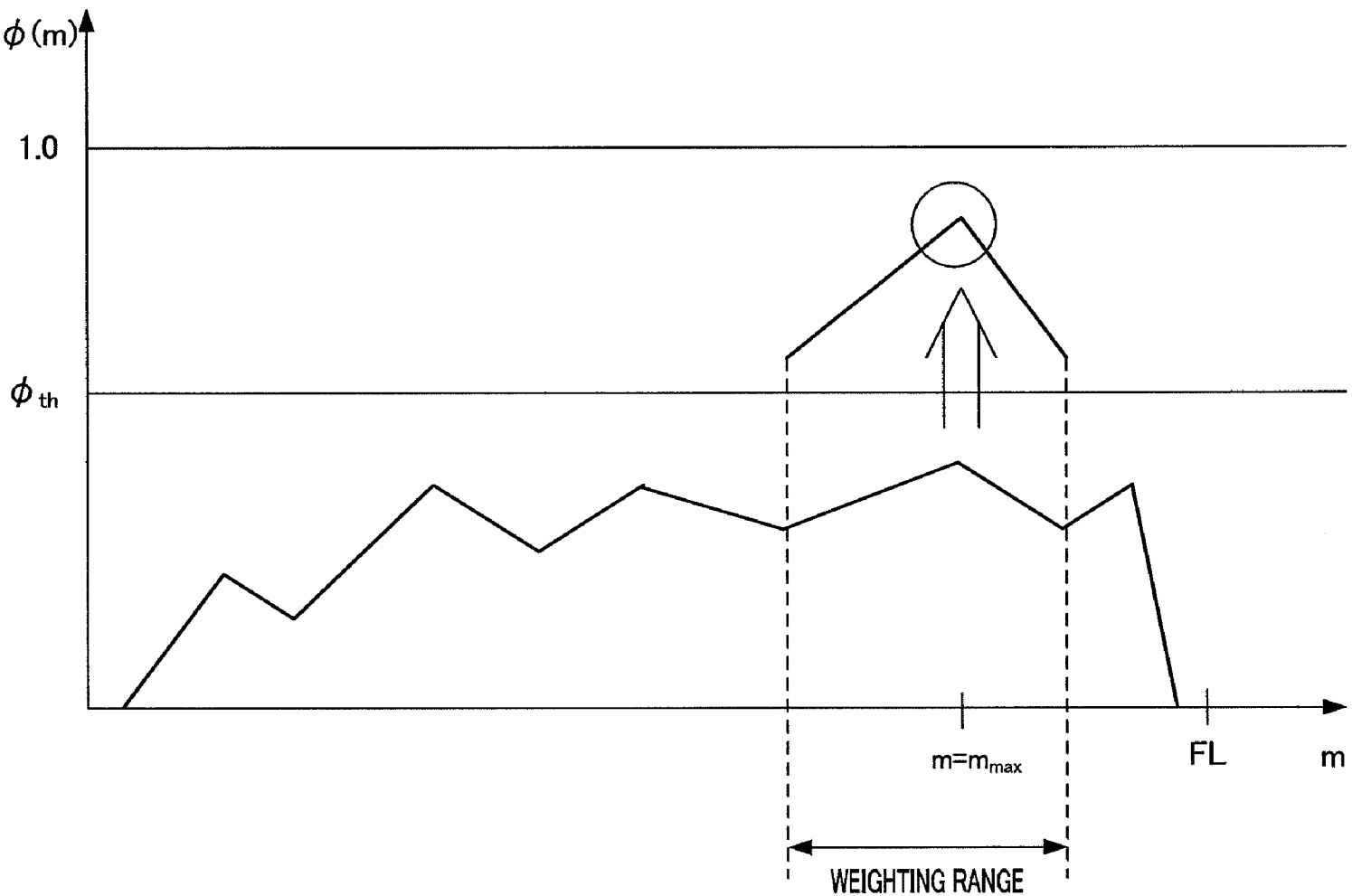
FIG. 22 shows an example of a case where a maximum cross-correlation value which has not exceeded threshold $\phi_{th}$ is weighted and thereby becomes a maximum cross-correlation value exceeding threshold $\phi_{th}$.
Figure 23:
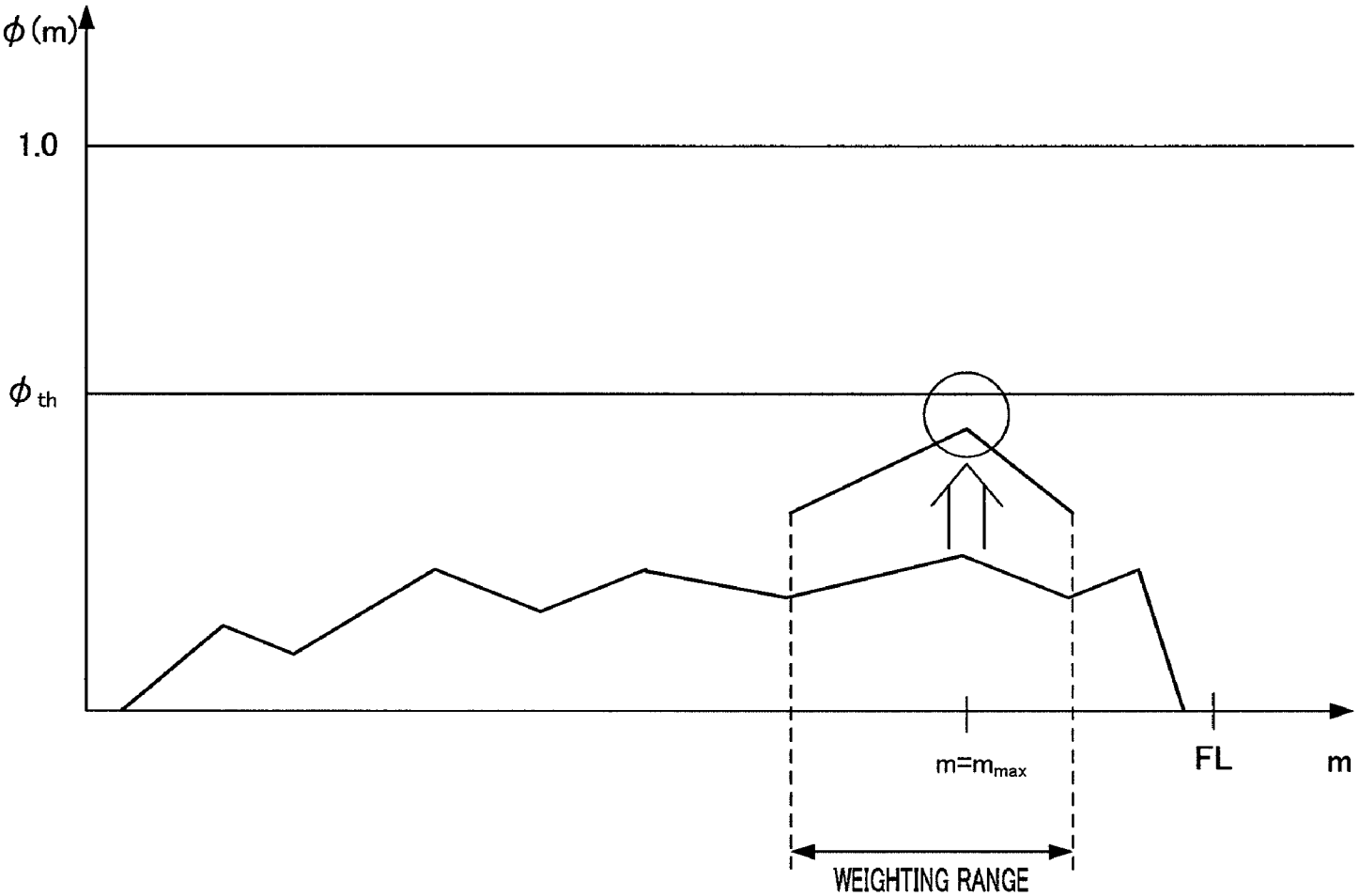
FIG. 23 shows an example of a case where a maximum cross-correlation value which has not exceeded threshold $\phi_{th}$ does not exceed threshold $\phi_{th}$ even after being weighted.

Furthermore, FIG. 22 shows an example of a case where a maximum cross-correlation value which has not exceeded threshold $\phi_{th}$ is weighted and thereby becomes a maximum cross-correlation value that exceeds threshold $\phi_{th}$. Furthermore, FIG. 23 shows an example of a case where a maximum cross-correlation value which has not exceeded threshold $\phi_{th}$ is weighted and still does not exceed threshold $\phi_{th}$. In the case shown in FIG. 23, the delay time difference of the current frame is set 0.

In this way, according to the present embodiment, when the difference between amount of shift m of a sample and the delay time difference of the previous frame is within a predetermined range, by weighting the cross-correlation function value, the cross-correlation function value with the amount of shift near the delay time difference of the previous frame is evaluated as a relatively greater value than the cross-correlation function value of other amounts of shift, and the amount of shift near the delay time difference of the previous frame is selected more easily, so that it is possible to calculate the delay time difference in the current frame more accurately.

Although a configuration has been described with the present embodiment where the weight by which the cross-correlation function value is multiplied varies according to the voiced/unvoiced sound decision result, a configuration may be employed where the cross-correlation function value is always multiplied by a fixed weight regardless of the voiced/unvoiced sound decision result.

Further, although examples have been described with Embodiment 5 to Embodiment 9 where processing on the first channel signal and second channel signal having passed through low pass filters, the processing of Embodiment 5 to Embodiment 9 may also be applied to signals not subjected to low pass filter processing.

Furthermore, instead of the first channel signal and second channel signal having passed through low pass filters, a residual signal (excitation signal) of the first channel signal having passed through the low pass filter and a residual signal (excitation signal) of the second channel signal having passed through the low pass filter may also be used.

Furthermore, instead of the first channel signal and second channel signal not subjected to low pass filter processing, the residual signal (excitation signal) of the first channel signal and the residual signal (excitation signal) of the second channel signal may also be used.

Embodiments of the present invention have been explained above.

The stereo coding apparatus and stereo signal prediction method according to the present invention are not limited to the above-described embodiments, but can be implemented with various modifications. For example, above-described embodiments may be implemented in combination as appropriate.

The stereo speech coding apparatus according to the present invention can be provided to communication terminal apparatuses and base station apparatuses in a mobile communication system, so that it is possible to provide a communication terminal apparatus, base station apparatus and mobile communication system having operational effects similar to those described above.

Although a case has been described with the above embodiments as an example where the present invention is implemented with hardware, the present invention can be implemented with software. For example, by describing the stereo coding method and stereo decoding method algorithm according to the present invention in a programming language, storing this program in a memory and making the information processing section execute this program, it is possible to implement the same function as the stereo coding apparatus and stereo decoding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-316754, filed on Oct. 31, 2005, Japanese Patent Application No. 2006-166458, filed on Jun. 15, 2006 and Japanese Patent Application No. 2006-271040, filed on Oct. 2, 2006, the entire content of which is expressly incorporated by reference herein.

INDUSTRIAL APPLICABILITY

The stereo coding apparatus and stereo signal prediction method according to the present invention are applicable to, for example, communication terminal apparatuses, base station apparatuses in a mobile communication system.

The invention claimed is:

1. A stereo coding apparatus, comprising:

a first low pass filter that lets a low-band component of a first channel signal pass;

a second low pass filter that lets a low-band component of a second channel signal pass;

a predictor that predicts the low-band component of the second channel signal from the low-band component of the first channel signal and generates a prediction parameter;

a memory that stores the prediction parameter;

a first coder that encodes the first channel signal; and a second coder that encodes the prediction parameter, wherein, based on a past prediction parameter stored in the memory, the predictor generates a prediction parameter within a predetermined range with reference to the past prediction parameter.

2. The stereo coding apparatus according to claim 1, wherein the predictor performs the prediction and generates information of a delay time difference and an amplitude ratio between the low-band component of the first channel signal and the low-band component of the second channel signal.

3. The stereo coding apparatus according to claim 2, further comprising a calculator that mutually shifts the low-band component of the first channel signal and the low-band component of the second channel signal, and calculates a value of a cross-correlation function of the first channel signal and the second channel signal, wherein, upon generating information of the delay time difference, the predictor sets an amount of shift that maximizes the cross-correlation function as a delay time difference, when the value of the cross-correlation function is equal to or greater than a threshold, and uses the delay time difference of a previous frame again when the value of the cross-correlation function is less than the threshold.

4. The stereo coding apparatus according to claim 3, further comprising a determiner that makes a voiced/unvoiced sound decision on the first channel signal and the second channel signal, wherein the predictor sets the threshold based on the decision result by the determiner.

5. The stereo coding apparatus according to claim 3, wherein, if a maximum value of the cross-correlation function is equal to or greater than a first threshold, the predictor sets an amount of shift that maximizes the cross-correlation function as the delay time difference, and, if the maximum value of the cross-correlation function is less than the first threshold and a maximum value of a smoothed cross-correlation value of the previous frame is equal to or greater than a second threshold, the predictor sets the delay time difference of the previous frame as the delay time difference of a current frame, and, if the maximum value of the smoothed cross-correlation value of the previous frame is less than the second threshold, the predictor sets the delay time difference of the current frame as 0.

6. The stereo coding apparatus according to claim 3, wherein, when the difference between the delay time difference of the previous frame and the amount of shift of a sample upon mutually shifting the low-band component of the first channel signal and the low-band component of the second channel signal is within a predetermined range, the predictor assigns a weight to the value of the cross-correlation function.

7. The stereo coding apparatus according to claim 6, further comprising:

a determiner that makes a voiced/unvoiced sound decision on the first channel signal and the second channel signal; and a weight setter that sets a weight based on the decision result by the determiner.

8. The stereo coding apparatus according to claim 2, further comprising:

a determiner that makes a voiced/unvoiced sound decision on the first channel signal and the second channel signal; and a calculator that mutually shifts the low-band component of the first channel signal and the low-band component of the second channel signal and calculates a value of a cross-correlation function of the first channel signal and the second channel signal, wherein, upon generating information of the delay time difference, the predictor sets the delay time difference according to a number of local peaks included within a predetermined range from a maximum value of the cross-correlation function.

9. The stereo coding apparatus according to claim 1, further comprising:

an acquisitioner that acquires power of the first channel signal and the second channel signal; and a determiner that determines cut-off frequencies of the first low pass filter and the second low pass filter based on the power of the first channel signal and the second channel signal.

10. The stereo coding apparatus according to claim 1, further comprising:

a detector that detects signal to noise ratios of the first channel signal and the second channel signal; and a determiner that determines cut-off frequencies of the first low pass filter and the second low pass filter based on the signal to noise ratios of the first channel signal and the second channel signal.

11. The stereo coding apparatus according to claim 1, further comprising a smoother that smoothes the prediction parameter, wherein the second coder encodes the smoothed prediction parameter.

12. A communication terminal apparatus comprising the stereo coding apparatus according to claim 1.

13. A base station apparatus comprising the stereo coding apparatus according to claim 1.

14. A stereo coding apparatus comprising:

a converter that converts a first channel signal and a second channel signal to a monaural signal;

a first low pass filter that lets a low-band component of the monaural signal pass;

a second low pass filter that lets a low-band component of the first channel signal pass;

a predictor that predicts the low-band component of the first channel signal from the low-band component of the monaural signal and generates a prediction parameter;

a first coder that encodes the monaural signal; and a second coder that encodes the first channel signal using the prediction parameter.

15. The stereo coding apparatus according to claim 14, wherein the second coder encodes the first channel signal separated into excitation information and vocal tract information and uses the prediction parameter for encoding the excitation information.

16. A stereo signal prediction method, comprising:

letting a low-band component of a first channel signal pass;

letting a low-band component of a second channel signal pass;

predicting the low-band component of the second channel signal from the low-band component of the first channel signal and generating a prediction parameter; and storing the prediction parameter in a memory, wherein, based on a past prediction parameter stored in the memory, generating the prediction parameter generates a prediction parameter within a predetermined range with reference to the past prediction parameter.

* * * * *